US009631847B2

(12) United States Patent
Tamaki et al.

(10) Patent No.: US 9,631,847 B2
(45) Date of Patent: Apr. 25, 2017

(54) REFRIGERATION CYCLE APPARATUS

(75) Inventors: Shogo Tamaki, Tokyo (JP); Makoto Saito, Tokyo (JP); Ryo Oya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 314 days.

(21) Appl. No.: 14/345,300

(22) PCT Filed: Oct. 4, 2011

(86) PCT No.: PCT/JP2011/005605

§ 371 (c)(1),
(2), (4) Date: Mar. 17, 2014

(87) PCT Pub. No.: WO2013/051059

PCT Pub. Date: Apr. 11, 2013

(65) Prior Publication Data

US 2014/0345310 A1 Nov. 27, 2014

(51) Int. Cl.
*F25B 27/00* (2006.01)
*F25B 13/00* (2006.01)
(Continued)

(52) U.S. Cl.
CPC ..... *F25B 29/003* (2013.01); *F25B 13/00* (2013.01); *F25B 2313/003* (2013.01);
(Continued)

(58) Field of Classification Search
CPC F25B 13/00; F25B 29/003; F25B 2313/0231; F25B 2313/0233;
(Continued)

(56) References Cited

U.S. PATENT DOCUMENTS 4,528,822 A * 7/1985 Glamm ..... F24D 5/12 62/238.6
2006/0000224 A1 1/2006 Matsuoka
(Continued)

FOREIGN PATENT DOCUMENTS

JP 57-184477 U 11/1982
JP 58-40464 A 3/1983
(Continued)

OTHER PUBLICATIONS

Office Action mailed Sep. 2, 2014 issued in corresponding JP patent application No. 2013-537274 (and English translation).
(Continued)

*Primary Examiner* — Ryan J Walters
*Assistant Examiner* — Joseph Trpisovsky
(74) *Attorney, Agent, or Firm* — Posz Law Group, PLC

(57) ABSTRACT

The volume ratio of a hot-water-supply-side liquid extension pipe to a water heat exchanger is set to be equal to or more than the minimum volume ratio, which is the volume ratio of the hot-water-supply-side liquid extension pipe to the water heat exchanger when the required refrigerant amount during a cooling and hot water supply simultaneous operation in which an indoor-side heat exchanger serves as an evaporator, the water heat exchanger serves as a condenser, cooling energy is supplied from the indoor-side heat exchanger, and heating energy is supplied from the water heat exchanger is equal to the required refrigerant amount during a heating operation in which a heat-source-side heat exchanger serves as an evaporator, the indoor-side heat exchanger serves as a condenser, and heating energy is supplied from the indoor-side heat exchanger.

13 Claims, 8 Drawing Sheets

(51) Int. Cl.
*F25B 1/00* (2006.01)
*F25B 39/02* (2006.01)
*F25B 29/00* (2006.01)

(52) U.S. Cl.
CPC . *F25B 2313/021* (2013.01); *F25B 2313/0231* (2013.01); *F25B 2313/0233* (2013.01); *F25B 2313/02741* (2013.01); *F25B 2313/0314* (2013.01); *F25B 2313/0315* (2013.01); *F25B 2341/066* (2013.01); *F25B 2600/0261* (2013.01); *F25B 2700/1931* (2013.01); *F25B 2700/21152* (2013.01); *F25B 2700/21161* (2013.01); *F25B 2700/21163* (2013.01)

(58) Field of Classification Search
CPC .... F25B 2313/02741; F25B 2313/0314; F25B 2313/0315; F25B 2313/021; F25B 2313/003; F25B 2341/066; F25B 2600/2061; F25B 2700/1931; F25B 2700/21152; F25B 2700/21163
USPC ..... 62/238.6, 238.7, 238.1, 292, 324.1, 498, 62/502, 504
See application file for complete search history.

(56) References Cited

U.S. PATENT DOCUMENTS

2006/0218948 A1 10/2006 Otake et al.
2008/0197206 A1* 8/2008 Murakami ..... F25B 13/00 237/2 B
2011/0000234 A1* 1/2011 Nishimura ..... F25B 49/005 62/77
2012/0055177 A1* 3/2012 Kim ..... F24D 11/0214 62/79

FOREIGN PATENT DOCUMENTS

| | | | |
|---|---|---|---|
| JP | 02-217756 | A | 8/1990 |
| JP | 2001-248937 | A | 9/2001 |
| JP | 2003-064352 | A | 3/2003 |
| JP | 2003-106672 | A | 4/2003 |
| JP | 2003-279174 | A | 10/2003 |
| JP | 2004-361036 | A | 12/2004 |
| JP | 2008-116155 | A | 5/2008 |
| JP | 2010-196950 | A | 9/2010 |

OTHER PUBLICATIONS

International Search Report of the International Searching Authority mailed Nov. 15, 2011 for the corresponding international application No. PCT/JP2011/005605 (and English translation).
Office Action dated May 26, 2015 issued in corresponding CN patent application No. 201180073987.4 (and English translation).
Extended European Search Report dated Jun. 18, 2015 issued in corresponding EP patent application No. 11873555.4.
EP Communication pursuant to Article 94(3) of Jan. 4, 2017 in the corresponding EP application No. 11873555.4.

* cited by examiner (a) CASE WHERE INSTALLATION DISTANCE BETWEEN HEAT SOURCE UNIT 301 AND HOT WATER SUPPLY UNIT 303 IS LONG (a) CASE WHERE INSTALLATION DISTANCE BETWEEN HEAT SOURCE UNIT 301 AND HOT WATER SUPPLY UNIT 303 IS SHORT (a) HEAT EXCHANGE BETWEEN REFRIGERANT AND OUTSIDE AIR (b) HEAT EXCHANGE BETWEEN REFRIGERANT AND WATER

REFRIGERATION CYCLE APPARATUS

CROSS REFERENCE TO RELATED APPLICATION

This application is a U.S. national stage application of International Application No. PCT/JP2011/005605 filed on Oct. 4, 2011, the disclosure of which is incorporated by reference.

TECHNICAL FIELD

The present invention relates to a vapor-compression refrigeration cycle apparatus and, more particularly, to a refrigeration cycle apparatus capable of independently performing an air-conditioning operation (cooling operation and heating operation) and a hot water supply operation and, furthermore, an exhaust heat recovery operation through a cooling and hot water supply simultaneous operation.

BACKGROUND ART

Refrigeration cycle apparatuses capable of independently performing an air-conditioning operation and a hot water supply operation in a single system have conventionally been available. One such known apparatus is a refrigeration cycle apparatus including a refrigerant circuit formed by a heat source unit, an indoor unit, and a hot water supply unit connected by pipes, thereby enabling simultaneous execution of an air-conditioning operation and a hot water supply operation (see, for example, Patent Literatures 1 and 2). In such a system, it is possible to recover heat exhausted upon cooling to use it for hot water supply by way of simultaneous execution of a cooling operation and a hot water supply operation, thus attaining a high-efficient operation.

CITATION LIST

Patent Literature

Patent Literature 1: Japanese Unexamined Patent Application Publication No. 2010-196950 (pages 34-36, FIG. 4, etc.)

Patent Literature 2: Japanese Unexamined Patent Application Publication No. 2001-248937 (pages 3-4, FIG. 4, etc.)

SUMMARY OF INVENTION

Technical Problem

In a heat pump system described in Patent Literature 1, during exhaust heat recovery by a cooling and hot water supply simultaneous operation, a heat-source-side heat exchanger is put under a high pressure atmosphere (see FIG. 4 in Patent Literature 1). Therefore, due to heat exchange with outside air in the heat-source-side heat exchanger, condensation of refrigerant occurs. In addition, in order to prevent the refrigerant from staying in the heat-source-side heat exchanger, it is necessary to supply a certain amount of refrigerant to the heat-source-side heat exchanger, which makes it impossible to completely recover exhaust heat upon cooling to use it for hot water supply.

A heat-pump hot water supply air-conditioning apparatus described in Patent Literature 2 is capable of putting an outdoor-side heat exchanger under a low pressure atmosphere at the time of a cooling and hot water supply simultaneous operation. This allows such a system to perform a complete exhaust heat recovery operation in which heat exhausted upon cooling is completely recovered to be used as that for hot water supply. However, due to switching of a four-way valve at the time of shifting from a cooling operation to a cooling and hot water supply simultaneous operation, a large amount of refrigerant stored in the outdoor-side heat exchanger flows into the suction side of a compressor, thus posing a problem of liquid back into the compressor. Further, since the outdoor-side heat exchanger is put under a low pressure atmosphere at the time of the cooling and hot water supply simultaneous operation, the outdoor-side heat exchanger is filled with a low-pressure gas refrigerant during the complete exhaust heat recovery operation. Therefore, a liquid reservoir with a large internal volume (capacity) is required for storing a large amount of excess refrigerant at the time of the cooling and hot water supply simultaneous operation.

For a refrigeration cycle apparatus which performs only a cooling operation and a heating operation (to be referred to as a "standard apparatus" hereinafter), which requires refrigerant in an amount smaller in a heating operation than in a cooling operation, it is necessary to store excess refrigerant in a liquid reservoir during the heating operation. In contrast, as for the heat-pump hot water supply air-conditioning apparatus described in Patent Literature 2, where the outdoor-side heat exchanger is filled with a low-pressure gas, the amount of refrigerant required for operation is further reduced compared to a heating operation by the standard apparatus. As a result, an excess refrigerant is generated more at the time of the cooling and hot water supply simultaneous operation than at the time of a heating operation. Accordingly, in order to store the excess refrigerant, a liquid reservoir with an internal volume (capacity) larger than that of the standard apparatus is required. As a result, the outer dimensions of the heat source unit body become larger, making it impossible to install it in a limited installation space.

The present invention has been made in order to solve the above problems, and has as its object to provide a low-cost refrigeration cycle apparatus that includes a liquid reservoir with a smaller internal volume and a heat source unit with outer dimensions equal to those of a standard apparatus that performs only cooling and heating operations.

Solution to Problem

A refrigeration cycle apparatus according to the present invention includes a heat source unit including a compressor, a heat-source-side heat exchanger, and an expansion valve; an indoor unit including an indoor-side heat exchanger; and a hot water supply unit including a water heat exchanger, the heat source unit and the indoor unit being connected together by indoor-side extension pipes including an indoor-side liquid extension pipe and an indoor-side gas extension pipe, and the heat source unit and the hot water supply unit being connected together by hot-water-supply-side extension pipes including a hot-water-supply-side liquid extension pipe and a hot-water-supply-side gas extension pipe. The volume ratio of the hot-water-supply-side liquid extension pipe to the water heat exchanger is set to be equal to or more than a minimum volume ratio, which is the volume ratio of the hot-water-supply-side liquid extension pipe to the water heat exchanger when a required refrigerant amount during a cooling and hot water supply simultaneous operation in which the indoor-side heat exchanger serves as an evaporator, the water heat exchanger serves as a condenser, cooling energy is supplied from the indoor-side heat exchanger, and heating energy is supplied from the water heat exchanger is equal to a required refrigerant amount during a heating operation in which the heat-source-side heat exchanger serves as an evaporator, the indoor-side heat exchanger serves as a condenser, and heating energy is supplied from the indoor-side heat exchanger.

Advantageous Effects of Invention

In a refrigeration cycle apparatus according to the present invention, the internal volume of a liquid reservoir can be made equal to that of a standard apparatus which performs only a cooling operation and a heating operation, thus achieving low cost and enabling the outer dimensions of a heat source unit to be equal to those of the standard apparatus.

DESCRIPTION OF EMBODIMENTS

Embodiments of the present invention will be described below with reference to the accompanying drawings.

Embodiment 1

Figure 1:
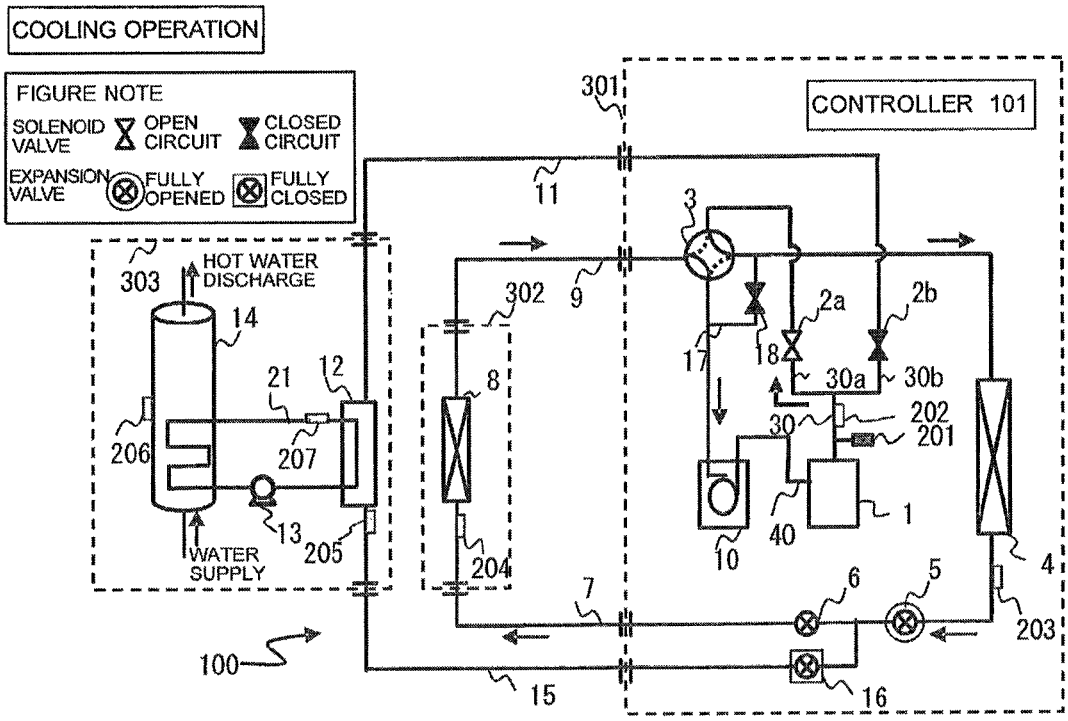
FIG. 1 is a schematic refrigerant circuit diagram illustrating a refrigerant circuit configuration of a refrigeration cycle apparatus according to Embodiment 1 of the present invention.

FIG. 1 is a schematic refrigerant circuit diagram illustrating a refrigerant circuit configuration of a refrigeration cycle apparatus 100 according to Embodiment 1 of the present invention. A part of the configuration and operation of the refrigeration cycle apparatus 100 will be described with reference to FIG. 1. The relationships of individual component members in the figures below, including FIG. 1, may be different in size from the actual state.

The refrigeration cycle apparatus 100, which is installed in a conventional home, an office building, or the like, is capable of, through a vapor-compression refrigeration cycle operation, independently processing a cooling instruction (cooling ON/OFF) or a heating instruction (heating ON/OFF) selected at an indoor unit 302, or a hot water supply instruction (hot water supply ON/OFF) given at a hot water supply unit 303. Further, the refrigeration cycle apparatus 100 is capable of simultaneously processing a cooling instruction of the indoor unit 302 and a hot water supply instruction of the hot water supply unit 303.

{Configuration of Refrigeration Cycle Apparatus 100}

The refrigeration cycle apparatus 100 includes a heat source unit 301, the indoor unit 302, and the hot water supply unit 303. The heat source unit 301 and the indoor unit 302 are connected by an indoor-side liquid extension pipe 7 which serves as a refrigerant pipe and an indoor-side gas extension pipe 9 which is a refrigerant pipe. The heat source unit 301 and the hot water supply unit 303 are connected by a hot-water-supply-side gas extension pipe 11 which is a refrigerant pipe and a hot-water-supply-side liquid extension pipe 15 which is a refrigerant pipe. Refrigerant used in the refrigeration cycle apparatus 100 is not particularly limited. For example, a refrigerant, such as R410A, R32, HFO-1234yf, or a natural refrigerant such as a hydrocarbon, can be used. The number of the heat source units 301, the indoor units 302, and the hot water supply units 303 which are connected to one another is not limited to the number illustrated.

[Heat Source Unit 301]

The heat source unit 301 includes a compressor 1, a discharge solenoid valve 2*a*, a discharge solenoid valve 2*b*, a four-way valve 3, a heat-source-side heat exchanger 4, a first expansion valve 5, a second expansion valve 6, an accumulator 10, a third expansion valve 16, and a low-pressure equalization solenoid valve 18.

The compressor 1 sucks refrigerant and compresses the sucked refrigerant to turn it into a high-temperature and high-pressure state, and the compressor 1 may be of a type in which, for example, an inverter controls the rotation speed of the compressor 1. To the compressor 1, a discharge-side pipe 30 and a suction-side pipe 40 are connected. The discharge-side pipe 30 is divided halfway (the four-way valve 3 and an upstream side of a water heat exchanger 12 of the hot water supply unit 303 described later). The discharge solenoid valve 2*a* is installed in a discharge-side pipe 30*a* and a discharge solenoid valve 2*b* is installed in the other discharge-side pipe 30*b*.

The discharge solenoid valve 2*a* is controlled to open and close for causing or not causing refrigerant to pass through the discharge-side pipe 30*a*. The discharge solenoid valve 2*b* is controlled to open and close for causing or not causing refrigerant to pass through discharge-side pipe 30*b*. The four-way valve 3 is installed downstream of the discharge solenoid valve 2*a* at the discharge-side pipe 30*a*. The water heat exchanger 12 of the hot water supply unit 303 is installed downstream of the discharge solenoid valve 2*b* at the discharge-side pipe 30*b* via the hot-water-supply-side gas extension pipe 11. The discharge-side pipe 30*b* may be connected to the hot-water-supply-side gas extension pipe 11 or the discharge-side pipe 30*b* may serve as the hot-water-supply-side gas extension pipe 11.

The four-way valve 3 switches the flow of refrigerant in accordance with an instruction from the indoor unit 302. In other words, the four-way valve 3 switches between the flow of refrigerant in response to a cooling instruction and the flow of refrigerant in response to a heating instruction from the indoor unit 302.

The heat-source-side heat exchanger 4 exchanges heat between refrigerant and air supplied from an air-sending device such as a fan, which is not illustrated, and removes heat from air or exhausts heat into air. The heat-source-side heat exchanger 4 may be configured, for example, with a cross-fin type fin-and-tube heat exchanger that includes a heat transfer pipe and a large number of fins.

The heat source unit 301 is provided with a low-pressure bypass pipe 17 for connecting the discharge solenoid valve 2*a* and the heat-source-side heat exchanger 4 to each other via the four-way valve 3, and an indoor-side heat exchanger 8 and the accumulator 10 to each other via the four-way valve 3. The low-pressure bypass pipe 17 is provided with the low-pressure equalization solenoid valve 18. The low-pressure equalization solenoid valve 18 is controlled to open and close for causing or not causing refrigerant to pass through the low-pressure bypass pipe 17.

The opening degree of each of the first expansion valve 5, the second expansion valve 6, and the third expansion valve 16 is variably controlled to, in turn, control the flow rate of refrigerant. The first expansion valve 5 is installed on the side of the heat-source-side heat exchanger 4 provided to the indoor-side liquid extension pipe 7 between the heat-source-side heat exchanger 4 and the indoor-side heat exchanger 8. The second expansion valve 6 is installed on the side of the indoor-side heat exchanger provided to at the indoor-side liquid extension pipe 7 between the heat-source-side heat exchanger 4 and the indoor-side heat exchanger 8. The third expansion valve 16 is installed at the hot-water-supply-side liquid extension pipe 15 which is connected between the first expansion valve 5 and the second expansion valve 6.

The flow direction of refrigerant which circulates through the refrigerant circuit can be set by controlling the opening degree of each of the first expansion valve 5, the second expansion valve 6, and the third expansion valve 16, opening and closing of each of the discharge solenoid valve 2*a* and the discharge solenoid valve 2*b*, switching of the flow passage of the four-way valve 3, and opening and closing of the low-pressure equalization solenoid valve 18.

The accumulator 10 is installed on the suction side of the compressor 1 and has a function of storing an excess refrigerant for operation and preventing a large amount of liquid refrigerant from flowing into the compressor 1 by storing the liquid refrigerant which is generated temporarily when the state of operation changes.

The heat source unit 301 is provided with a presser sensor 201, a first temperature sensor 202, and a second temperature sensor 203. The presser sensor 201 is installed on the discharge side of the compressor 1 and measures the pressure of refrigerant at the place where the pressure sensor 201 is installed. The first temperature sensor 202 is installed on the discharge side of the compressor 1 and measures the temperature of refrigerant at the place where the first temperature sensor 202 is installed. The second temperature sensor 203 is installed on the liquid side of the heat-source-side heat exchanger 4 (between the heat-source-side heat exchanger 4 and the first expansion valve 5) and measures the temperature of refrigerant at the place where the second temperature sensor 203 is installed.

Further, the heat source unit 301 is provided with a controller 101. The controller 101, based on instructions from the indoor unit 302 and the hot water supply unit 303, controls operating elements (actuators) including the compressor 1, the discharge solenoid valve 2*a*, the discharge solenoid valve 2*b*, the low-pressure equalization solenoid valve 18, the four-way valve 3, the first expansion valve 5, the second expansion valve 6, the third expansion valve 16, and a fan installed near the heat-source-side heat exchanger 4, provided in the heat source unit 301. Measurement information from the pressure sensor 201, the first temperature sensor 202, and the second temperature sensor 203 is sent to the controller 101 and utilized for controlling the actuators.

The controller 101 is configured by, for example, a microcomputer and the like. The controller 101 is provided at least with measuring means for obtaining measurement information from various sensors (the pressure sensor 201, the first temperature sensor 202, other temperature sensors (including temperature sensors installed in the indoor unit 302 and the hot water supply unit 303), and the like), calculating means (degree-of-subcooling controlling means) for calculating condensing temperature, the degree of subcooling, and the like from measurement information, and controlling means for controlling an actuator based on a calculation result and an operation content specified by a user of a refrigerating and air-conditioning apparatus.

[Indoor Unit 302]

The indoor unit 302 is provided with the indoor-side heat exchanger 8. The indoor-side heat exchanger 8 exchanges heat between refrigerant and indoor air supplied from an air-sending device such as a fan, which is not illustrated, and removes heat from indoor air or exhausts heat into indoor air. The indoor-side heat exchanger 8 may be configured, for example, by a cross-fin type fin-and-tube heat exchanger that includes a heat transfer pipe and a large number of fins.

The indoor unit 302 is provided with a third temperature sensor 204 on the liquid side of the indoor-side heat exchanger 8 (between the indoor-side heat exchanger 8 and the second expansion valve 6) for measuring the temperature of refrigerant at the place where the third temperature sensor 204 is installed. Measurement information from the third temperature sensor 204 is sent to the controller 101 of the heat source unit 301 and utilized for controlling the actuators.

[Hot Water Supply Unit 303]

The hot water supply unit 303 includes the water heat exchanger 12, a water-side circuit 21, a water pump 13 and a hot water storage tank 14.

The water-side circuit 21 connects the water heat exchanger 12 and the hot water storage tank 14 together, and circulates water which is a heat exchange medium as intermediate water between the water heat exchanger 12 and the hot water storage tank 14.

The water heat exchanger 12 is configured, for example, by a plate-type water heat exchanger and exchanges heat between intermediate water and refrigerant to heat water up to hot water.

The water pump 13 has a function of causing intermediate water to circulate through the water-side circuit 21. The water pump 13 may be configured such that the flow rate of water supplied to the water heat exchanger 12 can be variably adjusted, or such that the flow rate is maintained constant.

The hot water storage tank 14 has a function of storing hot water heated in the water heat exchanger 12. The hot water storage tank 14 is a water filling type which stores hot water while forming thermal stratification for storing high-temperature water in the upper part and low-temperature water in the lower part. In response to a hot water discharge request from a load side, hot water is discharged from the upper part of the hot water storage tank 14. Regarding the decrease amount of hot water in the hot water storage tank 14 at the time of hot water discharge, low-temperature city water is supplied from below the hot water storage tank 14 and is kept to stay in the lower part of the hot water storage tank 14.

In the hot water supply unit 303, water sent by the water pump 13 is heated into hot water by refrigerant in the water heat exchanger 12 and then flows into the hot water storage tank 14. The hot water is not mixed with water in the hot water storage tank 14, but exchanges heat with water in the hot water storage tank 14 as intermediate water and turns into cold water. Then, the cold water flows out of the hot water storage tank 14, flows into the water pump 13, and is resent to the water heat exchanger 12 where the water is turned into hot water. Through the above process water is heated, and the heated water is stored in the hot water storage tank 14.

A heating method of water in the hot water storage tank 14 by the hot water supply unit 303 is not limited to a heat exchange method through intermediate water as described in Embodiment 1. A heating method of letting water in the hot water storage tank 14 flow directly into a pipe, having the water heat-exchanged in the water heat exchanger 12 to turn into hot water, and returning the hot water to the hot water storage tank 14, may be employed.

The hot water supply unit 303 is provided with a fourth temperature sensor 205, a fifth temperature sensor 206, and a sixth temperature sensor 207. The fourth temperature sensor 205 is installed on the liquid side of the water heat exchanger 12 (between the water heat exchanger 12 and the third expansion valve 16) for measuring the temperature of refrigerant at the place where the fourth temperature sensor 205 is installed. The fifth temperature sensor 206 is installed on a tank wall of the hot water storage tank 14 for measuring the temperature of water at the place where the fifth temperature sensor 206 is installed. The sixth temperature sensor 207 is installed on the water outlet side of the water heat exchanger 12 for measuring the temperature of water at the place where the sixth temperature sensor 207 is installed. The measurement information of the fourth temperature sensor 205, the fifth temperature sensor 206, and the sixth temperature sensor 207 is sent to the controller 101 of the heat source unit 301 and utilized for controlling the actuators.

{Operation Mode of Refrigeration Cycle Apparatus 100}

The refrigeration cycle apparatus 100 controls each part installed in the heat source unit 301, the indoor unit 302, and the hot water supply unit 303 based on each air conditioning load required for the indoor unit 302 and in response to a hot water supply request required for the hot water supply unit 303. The refrigeration cycle apparatus 100 is capable of executing a cooling operation mode, a heating operation mode, a hot water supply operation mode, and a cooling and hot water supply simultaneous operation mode. Although the refrigeration cycle apparatus 100 is a refrigerant circuit configured to be capable of a heating and hot water supply simultaneous operation, due to the fact that neither the compressor 1 nor the heat-source-side heat exchanger 4 has a capacity large enough to secure a heating capacity and a hot water supply capacity simultaneously, the refrigeration cycle apparatus 100 is not assumed to execute a heating and hot water supply simultaneous operation. Operations in each operation mode will be described below.

[Cooling Operation Mode]

First, a cooling operation mode will be described with reference to FIG. 1. The arrows in FIG. 1 indicate the flow direction of refrigerant. In the case of the cooling operation mode illustrated in FIG. 1, the heat source unit 301 switches the four-way valve 3 such that the discharge side of the compressor 1 is connected to the gas side of the heat-source-side heat exchanger 4 and the suction side of the compressor 1 is connected to the gas side of the indoor-side heat exchanger 8 (solid lines illustrated in FIG. 1). Further, the discharge solenoid valve 2*a* is controlled to open the circuit (void), the discharge solenoid valve 2*b* is controlled to close the circuit (solid), and the low-pressure equalization solenoid valve 18 is controlled to close the circuit (solid). Moreover, the first expansion valve 5 is controlled to have the maximum opening degree (fully opened), the second expansion valve 6 is controlled to have a desired opening degree, and the third expansion valve 16 is controlled to have the minimum opening degree (fully closed).

A low-temperature and low-pressure refrigerant is compressed by the compressor 1 and discharged as a high-temperature and high-pressure gas refrigerant. The high-temperature and high-pressure gas refrigerant discharged from the compressor 1 flows into the heat-source-side heat exchanger 4 via the discharge solenoid valve 2*a* and the four-way valve 3. Then, the high-temperature and high-pressure gas refrigerant exchanges heat with outdoor air at the heat-source-side heat exchanger 4, and turns into a high-pressure liquid refrigerant. Then, the refrigerant flows out of the heat-source-side heat exchanger 4, passes through the first expansion valve 5, and is decompressed at the second expansion valve 6 to turn into a low-pressure two-phase refrigerant. The two-phase refrigerant then flows out of the heat source unit 301.

The two-phase refrigerant which has flowed out of the heat source unit 301 flows into the indoor unit 302 via the indoor-side liquid extension pipe 7. The refrigerant which has flowed into the indoor unit 302 flows into the indoor-side heat exchanger 8, cools indoor air, and turns into a low-temperature and low-pressure gas refrigerant. Then, the gas refrigerant flows out of the indoor unit 302 and flows into the heat source unit 301 via the indoor-side gas extension pipe 9. The gas refrigerant which has flowed into the heat source unit 301 is again sucked in the compressor 1 through the four-way valve 3 and the accumulator 10. Since the hot water supply unit 303 is suspended, refrigerant does not flow in a portion from the discharge solenoid valve 2*b* to the third expansion valve 16, which is filled with a gas-phase refrigerant.

[Heating Operation Mode]

Figure 2:
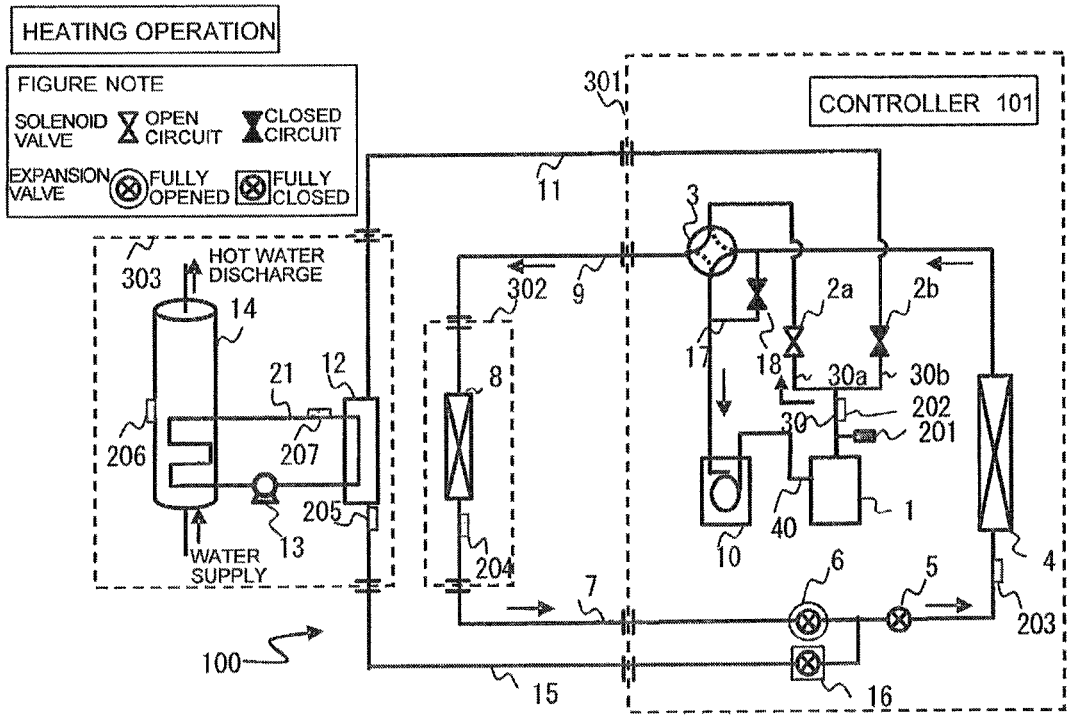
FIG. 2 is a refrigerant circuit diagram illustrating the flow of refrigerant in a heating operation mode of the refrigeration cycle apparatus according to Embodiment 1 of the present invention.

Next, a heating operation mode will be described with reference to FIG. 2. FIG. 2 is a refrigerant circuit diagram illustrating the flow of refrigerant in a heating operation mode of the refrigeration cycle apparatus 100. The arrows in FIG. 2 indicate the flow direction of refrigerant. In the case of the heating operation mode illustrated in FIG. 2, the heat source unit 301 switches the four-way valve 3 such that the discharge side of the compressor 1 is connected to the gas side of the indoor-side heat exchanger 8 and the suction side of the compressor 1 is connected to the gas side of the heat-source-side heat exchanger 4 (solid lines illustrated in FIG. 2). Further, the discharge solenoid valve 2*a* is controlled to open the circuit (void), the discharge solenoid valve 2*b* is controlled to close the circuit (solid), and the low-pressure equalization solenoid valve 18 is controlled to close the circuit (solid). Moreover, the first expansion valve 5 is controlled to have a desired opening degree, the second expansion valve 6 is controlled to have the maximum opening degree (fully opened), and the third expansion valve 16 is controlled to have the minimum opening degree (fully closed).

A low-temperature and low-pressure refrigerant is compressed by the compressor 1 and discharged as a high-temperature and high-pressure gas refrigerant. The high-temperature and high-pressure gas refrigerant discharged from the compressor 1 flows out of the heat source unit 301 via the discharge solenoid valve 2*a* and the four-way valve 3. The refrigerant which has flowed out of the heat source unit 301 flows into the indoor unit 302 via the indoor-side gas extension pipe 9. Then, the refrigerant flows into the indoor-side heat exchanger 8, heats indoor air to turn into a high-pressure liquid refrigerant, and flows out of the indoor-side heat exchanger 8.

Then, the liquid refrigerant flows out of the heat source unit 302 and flows in the heat source unit 301 via the indoor-side liquid extension pipe 7. The refrigerant which has flowed into the heat source unit 301 passes through the second expansion valve 6 and is decompressed at the first expansion valve 5 to turn into a low-pressure two-phase refrigerant. Then, the low-pressure two-phase refrigerant flows into the heat-source-side heat exchanger 4, exchanges heat with outdoor air, and turns into a low-temperature and low-pressure gas refrigerant. After that, the gas refrigerant is again sucked in the compressor 1 via the four-way valve 3 and the accumulator 10. Since the hot water supply unit 303 is suspended, refrigerant does not flow in a portion from the discharge solenoid valve 2*b* to the third expansion valve 16, which is filled with a gas-phase refrigerant.

[Hot Water Supply Operation Mode]

Figure 3:
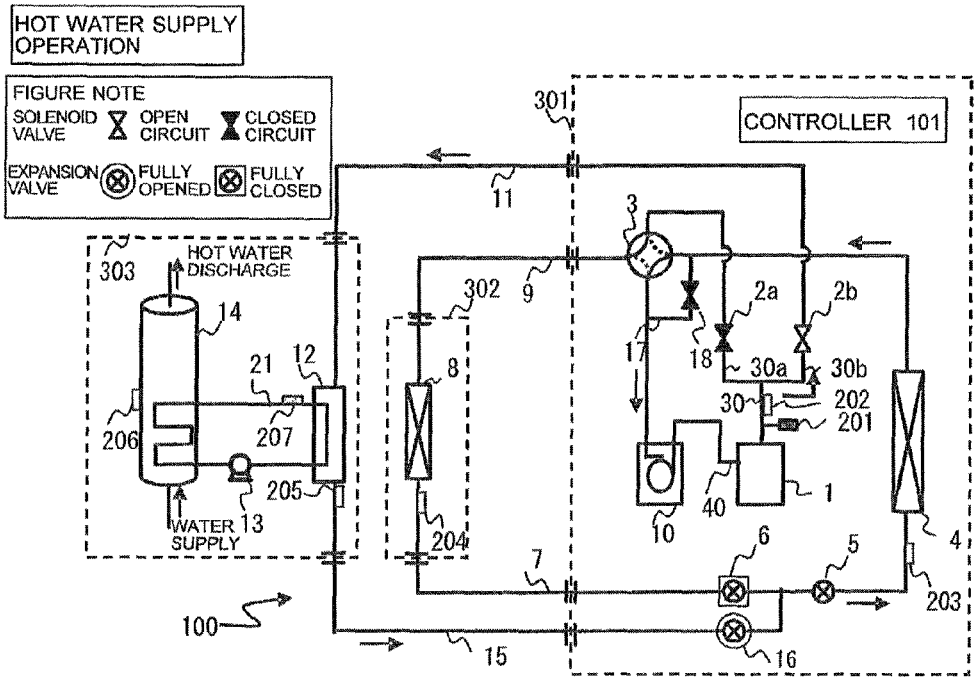
FIG. 3 is a refrigerant circuit diagram illustrating the flow of refrigerant in a hot water supply operation mode of the refrigeration cycle apparatus according to Embodiment 1 of the present invention.

Next, a hot water supply operation mode will be described with reference to FIG. 3. FIG. 3 is a refrigerant circuit diagram illustrating the flow of refrigerant in the hot water supply operation mode of the refrigeration cycle apparatus 100. The arrows in FIG. 3 indicate the flow direction of refrigerant. In the case of the hot water supply operation mode illustrated in FIG. 3, the heat source unit 301 switches the four-way valve 3 such that the suction side of the compressor 1 is connected to the gas side of the heat-source-side heat exchanger 4 (solid lines illustrated in FIG. 3). Further, the discharge solenoid valve 2*a* is controlled to close the circuit (solid), the discharge solenoid valve 2*b* is controlled to open the circuit (void), and the low-pressure equalization solenoid valve 18 is controlled to close the circuit (solid). Moreover, the first expansion valve 5 is controlled to have a desired opening degree, the second expansion valve 6 is controlled to have the minimum opening degree (fully closed), and the third expansion valve 16 is controlled to have the maximum opening degree (fully opened).

A low-temperature and low-pressure refrigerant is compressed by the compressor 1 and discharged as a high-temperature and high-pressure gas refrigerant. The high-temperature and high-pressure gas refrigerant discharged from the compressor 1 passes through the discharge solenoid valve 2*b* and flows out of the heat source unit 301. After that, the refrigerant flows into the hot water supply unit 303 via the hot-water-supply-side gas extension pipe 11. The refrigerant which has flowed into the hot water supply unit 303 flows into the water heat exchanger 12, heats water supplied by the water pump 13, and turns into a high-pressure liquid refrigerant. Then, the liquid refrigerant flows out of the water heat exchanger 12, and after flowing out of the hot water supply unit 303, the liquid refrigerant flows into the heat source unit 301 via the hot-water-supply-side liquid extension pipe 15.

Then, the refrigerant passes through the third expansion valve 16, is decompressed at the first expansion valve 5, and turns into a low-pressure two-phase refrigerant. After that, the two-phase refrigerant flows into the heat-source-side heat exchanger 4, cools outdoor air, and turns into a low-temperature and low-pressure gas refrigerant. The gas refrigerant which has flowed out of the heat-source-side heat exchanger 4 is again sucked in the compressor 1 via the four-way valve 3 and the accumulator 10. Since the indoor unit 302 is suspended, refrigerant does not flow in a portion from the discharge solenoid valve 2*a* to the second expansion valve 6, which is filled with a gas-phase refrigerant.

As described above, the refrigeration cycle apparatus 100 is capable of independent execution of a cooling operation of the indoor unit 302, a heating operation of the indoor unit 302, and a hot water supply operation of the hot water supply unit 303. Specifically, the refrigeration cycle apparatus 100 is capable of independently executing a cooling operation mode, a heating operation mode, and a hot water supply operation mode, in accordance with a cooling instruction (cooling ON/OFF) or a heating instruction (heating ON/OFF) selected at the indoor unit 302 and a hot water supply instruction (hot water supply ON/OFF) given at the hot water supply unit 303.

[Cooling and Hot Water Supply Simultaneous Operation Mode]

Figure 4:
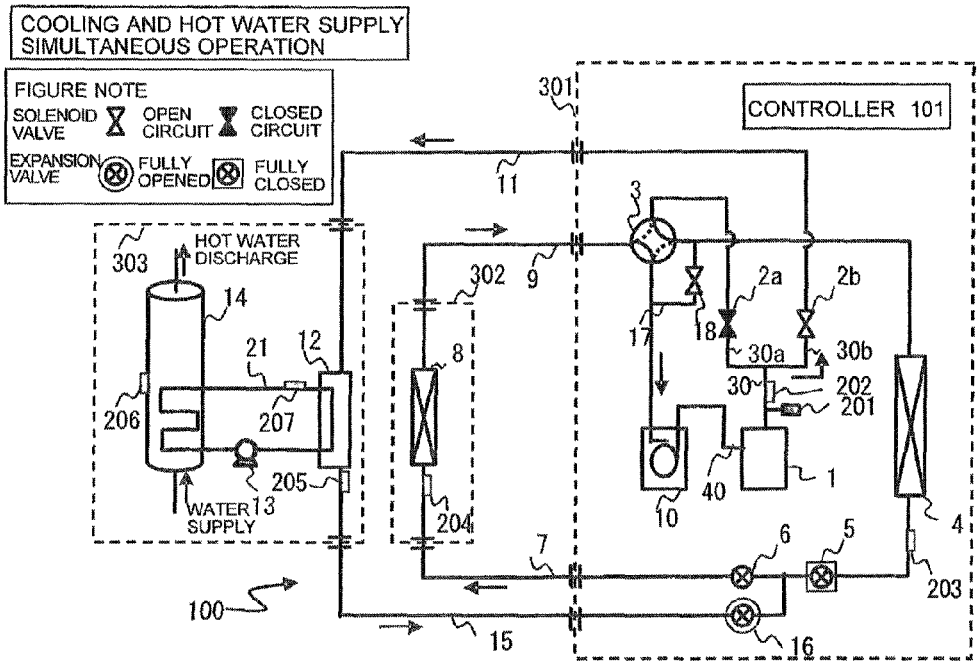
FIG. 4 is a refrigerant circuit diagram illustrating the flow of refrigerant in a cooling and hot water supply simultaneous operation mode of the refrigeration cycle apparatus according to Embodiment 1 of the present invention.

Next, a cooling and hot water supply simultaneous operation mode will be described with reference to FIG. 4. FIG. 4 is a refrigerant circuit diagram illustrating the flow of refrigerant in the cooling and hot water supply simultaneous operation mode of the refrigeration cycle apparatus 100. The arrows in FIG. 4 indicate the flow direction of refrigerant. In the case of the cooling and hot water supply simultaneous operation mode illustrated in FIG. 4, the heat source unit 301 switches the four-way valve 3 such that the suction side of the compressor 1 is connected to the gas side of the indoor-side heat exchanger 8 (solid lines in FIG. 4). Further, the discharge solenoid valve 2*a* is controlled to close the circuit (solid), the discharge solenoid valve 2*b* is controlled to open the circuit (void), and the low-pressure equalization solenoid valve 18 is controlled to open the circuit (void). Moreover, the first expansion valve 5 is controlled to have the minimum opening degree (fully closed), the second expansion valve 6 is controlled to have a desired opening degree, and the third expansion valve 16 is controlled to have the maximum opening degree (fully opened).

A low-temperature and low-pressure refrigerant is compressed by the compressor 1 and discharged as a high-temperature and high-pressure gas refrigerant. The high-temperature and high-pressure gas refrigerant discharged from the compressor 1 passes through the discharge solenoid valve 2*b* and flows out of the heat source unit 301. After that, the refrigerant flows into the hot water supply unit 303 via the hot-water-supply-side gas extension pipe 11. The refrigerant which has flowed into the hot water supply unit 303 flows into the water heat exchanger 12, heats water supplied by the water pump 13, and turns into a high-pressure liquid refrigerant. Then, the liquid refrigerant flows out of the water heat exchanger 12, and after flowing out of the hot water supply unit 303, the liquid refrigerant flows into the heat source unit 301 via the hot-water-supply-side liquid extension pipe 15.

The refrigerant then passes through the third expansion valve 16, is decompressed at the second expansion valve 6, and turns into a low-pressure two-phase refrigerant. After that, the two-phase refrigerant flows out of the heat source unit 301. The refrigerant which has flowed out of the heat source unit 301 flows into the indoor unit 302 via the indoor-side liquid extension pipe 7. The refrigerant which has flowed into the indoor unit 302 flows into the indoor-side heat exchanger 8, cools indoor air, and turns into a low-temperature and low-pressure gas refrigerant. The refrigerant which has flowed out of the indoor-side heat exchanger 8 then flows out of the indoor unit 302, flows into the heat source unit 301 via the indoor-side gas extension pipe 9, and is sucked in the compressor 1 via the four-way valve 3 and the accumulator 10.

As described above, the refrigeration cycle apparatus 100 is capable of simultaneous execution of a cooling operation of the indoor unit 302 and a hot water supply operation of the hot water supply unit 303. Specifically, the refrigeration cycle apparatus 100 is capable of simultaneously processing a cooling instruction (cooling ON/OFF) selected at the indoor unit 302 and a hot water supply instruction (hot water supply ON/OFF) given at the hot water supply unit 303.

Figure 5:
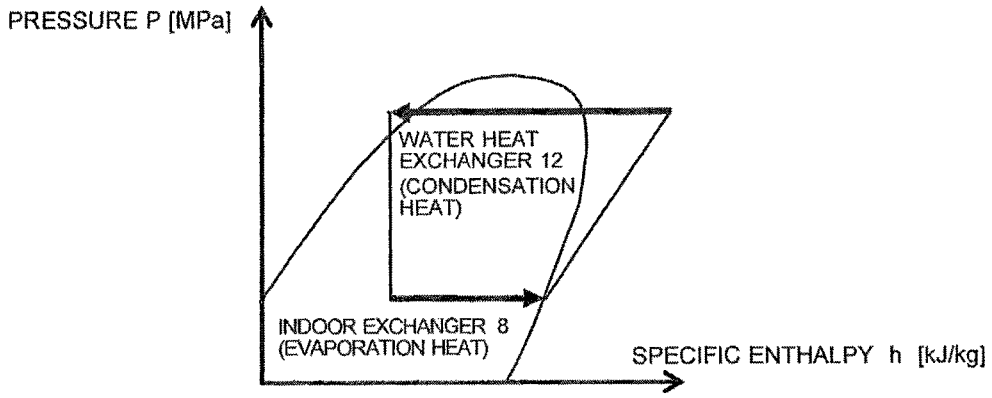
FIG. 5 is a P-h graph illustrating transitions of the state of refrigerant in a cooling and hot water supply simultaneous operation mode of the refrigeration cycle apparatus according to Embodiment 1 of the present invention.

The operational state of the cooling and hot water supply simultaneous operation mode is illustrated in FIG. 5. FIG. 5 is a P-h graph illustrating transitions of the state of refrigerant in the cooling and hot water supply simultaneous operation mode. As is clear from FIG. 5, in the cooling and hot water supply simultaneous operation mode, the state in which the entire exhaust heat from evaporation heat of the indoor-side heat exchanger 8 is recovered as condensation heat by the water heat exchanger 12 is achieved. In other words, in the cooling and hot water supply simultaneous operation mode, the state in which exhaust heat is completely recovered is achieved with no exhaust heat from the heat-source-side heat exchanger 4, which provides a high operational efficiency.

Further, since the refrigeration cycle apparatus 100 controls the first expansion valve 5 to have an opening degree corresponding to being fully closed in the cooling and hot water supply simultaneous operation mode, refrigerant does not flow into the heat-source-side heat exchanger 4. Because of this, the amount of the heat exchanged at the heat-source-side heat exchanger 4 is zero. Moreover, in the refrigeration cycle apparatus 100, by closing the discharge solenoid valve 2*a* and opening the low-pressure equalization solenoid valve 18, the gas side of the heat-source-side heat exchanger 4 is get connected to the suction part of the compressor 1. Accordingly, the heat-source-side heat exchanger 4 is put under a low-pressure atmosphere, thus preventing refrigerant from staying in the heat-source-side heat exchanger 4.

In the case where neither the discharge solenoid valve 2*a* nor the low-pressure equalization solenoid valve 18 is provided, the heat-source-side heat exchanger 4 will be put under a high-pressure atmosphere. This causes refrigerant to condense and liquefy by outside air and the refrigerant stays. In this case, it is therefore necessary to let refrigerant flow into the heat-source-side heat exchanger 4 to prevent the refrigerant from staying. On the other hand, when the discharge solenoid valve 2*a* and the low-pressure equalization solenoid valve 18 are provided as is the case with the refrigeration cycle apparatus 100, since the heat-source-side heat exchanger 4 can be put under a low-pressure atmosphere, which does not cause refrigerant to liquefy by outside air, there is no need to let refrigerant flow into the heat-source-side heat exchanger 4, thus allowing a refrigerant flow amount to the heat-source-side heat exchanger 4 to be zero. This makes it possible to let the entire refrigerant flow into the indoor unit 302, thus realizing complete exhaust heat recovery. As a result, the operational efficiency is improved in the refrigeration cycle apparatus 100.

In the refrigeration cycle apparatus 100, the low-pressure equalization solenoid valve 18 is controlled to open in the cooling and hot water supply simultaneous operation mode in which exhaust heat is recovered and is controlled to close in other operation modes.

[Downsizing of Capacity of Liquid Reservoir]

It is assumed here that the indoor-side gas extension pipe 9 and the indoor-side liquid extension pipe 7 have the same length. Therefore, the indoor-side gas extension pipe 9 and the indoor-side liquid extension pipe 7 are collectively called an indoor-side extension pipe, and its length is called an indoor-side extension pipe length. Specifically, the indoor-side extension pipe length refers to the length of a pipe connecting the heat source unit 301 and the indoor unit 302 together, and refers to the pipe length between the dotted line of the heat source unit 301 and the dotted line of the indoor unit 302 illustrated in FIG. 4. Further, it is assumed that the hot-water-supply-side gas extension pipe 11 and the hot-water-supply-side liquid extension pipe 15 also have the same length. Therefore, the hot-water-supply-side gas extension pipe 11 and the hot-water-supply-side liquid extension pipe 15 are collectively called a hot-water-supply-side extension pipe, and its length is called a hot-water-supply-side extension pipe length. Specifically, the hot-water-supply-side extension pipe length refers to the length of a pipe connecting the heat source unit 301 and the hot water supply unit 303 together, and refers to a pipe length between the dotted line of the heat source unit 301 and the dotted line of the hot water supply unit 303 illustrated in FIG. 4. Moreover, the minimum amount of refrigerant necessary for operation in each operation mode is called a required refrigerant amount.

Here, an operation mode in which the required refrigerant amount is smallest will be examined in the case where the indoor-side extension pipe length is 0 m and the hot-water-supply-side extension pipe length is 0 m. For example, when the refrigeration cycle apparatus 100 of 3HP is assumed, the approximate internal volume of the heat-source-side heat exchanger 4 is 4.5 L, that of the indoor-side heat exchanger 8 is 1.5 L, and that of the water heat exchanger 12 is 0.7 L.

Therefore, the heat-source-side heat exchanger 4 has an internal volume larger than any other heat exchangers. Accordingly, it is the cooling operation mode in which the heat-source-side heat exchanger 4 serves as a condenser that requires a largest required refrigerant amount.

In both the heating operation mode and the hot water supply operation mode, the heat-source-side heat exchanger 4 serves as an evaporator and refrigerant in the heat-source-side heat exchanger 4 is in a two-phase state. In this regard, both the heating operation mode and the hot water supply operation mode are the same. However, since the internal volume of the water heat exchanger 12 is smaller than that of the indoor-side heat exchanger 8, when the heat-source-side heat exchanger 4 serves as a condenser, the amount of refrigerant is greater at the indoor-side heat exchanger 8 than at the water heat exchanger 12. Consequently, the heating operation mode requires the second largest refrigerant amount to the cooling operation mode, followed by the hot water supply operation mode.

In the cooling and hot water supply simultaneous operation mode, the heat-source-side heat exchanger 4 is put under a low-pressure atmosphere taking the position of an evaporator. However, refrigerant does not flow and the evaporating temperature is lower than the temperature of outside air. Because of this, refrigerant at the heat-source-side heat exchanger 4 is in a gas-phase state. As is clear from the above, the cooling and hot water supply simultaneous operation mode is the operation mode that requires the smallest refrigerant amount.

In the case of a conventional standard refrigeration cycle apparatus which performs only a cooling operation mode and a heating operation mode, from the above reasons, it is the heating operation mode that requires the smallest refrigerant amount. The internal volume (capacity) of a liquid reservoir (accumulator) is determined based on the excess refrigerate amount which is equal to the difference in required refrigerant amount between the operation mode that requires the largest refrigerant amount and the operation mode that requires the smallest refrigerant amount. In other words, the larger the excess refrigerate amount is, the larger the required capacity for a liquid reservoir becomes. Accordingly, with a conventional refrigeration cycle apparatus, the capacity of a liquid reservoir has been determined in accordance with the difference in required refrigerant amount between the cooling operation mode and the heating operation mode.

However, as for the refrigeration cycle apparatus 100, since the required refrigerant amount in the cooling and hot water supply simultaneous operation mode is smaller than that in the heating operation mode, the capacity of a liquid reservoir, that is, the capacity of the accumulator 10, is set by the cooling operation mode and the cooling and hot water supply simultaneous operation mode. Consequently, the capacity of a liquid reservoir is larger than that of a standard refrigeration cycle apparatus, thus the outer dimensions of the heat source unit 301 being increased. As a result, it becomes impossible to install the system in a limited space.

Here, refrigerant at the indoor-side liquid extension pipe 7 turns into a two-phase state in the cooling operation mode and into a liquid-phase state in the heating operation mode. Since the refrigerant density in the liquid phase state is higher than that in the two-phase state, in the case where an indoor-side extension pipe is long, the required refrigerant amount in the heating operation mode is larger than that in the cooling operation mode. Further, when the indoor-side extension pipe length is long, the difference in required refrigerant amount between the cooling operation mode and the heating operation mode is larger than that in the case where the indoor-side extension pipe length is 0 m. This leads to an increase in the excess refrigerant amount, requiring a corresponding capacity of a liquid reservoir, which results in an increase in the outer dimensions of a heat source unit even with a standard apparatus. Therefore, with the refrigeration cycle apparatus 100 in comparison with a standard apparatus, the longest length of the indoor-side extension pipe is set in such a manner that the difference in required refrigerant amount between the cooling operation mode and the heating operation mode is smaller than or equal to that in the case where the indoor-side extension pipe is 0 m.

Figure 6:
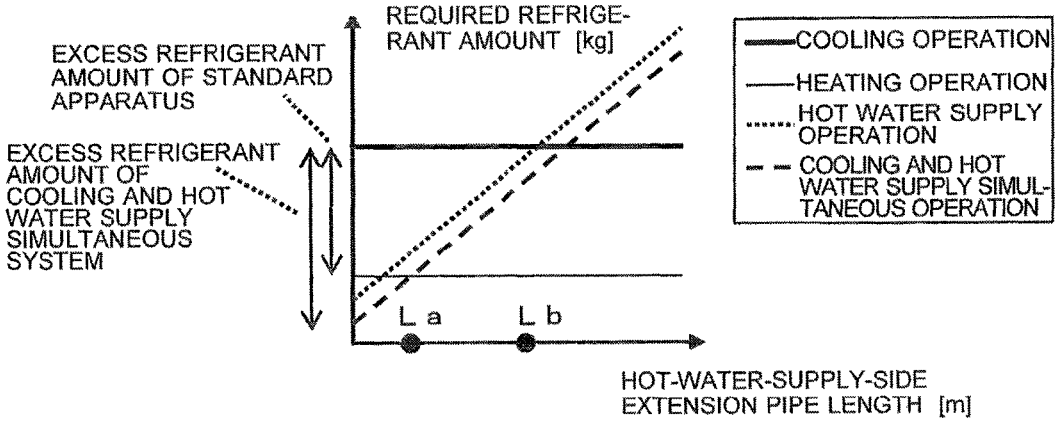
FIG. 6 is a graph illustrating the relationship between the hot-water-supply-side extension pipe length and the amount of refrigerant required in each operation mode when the indoor-side extension pipe length is 0 m.

Next, a method of equalizing the excess refrigerant amount of the refrigeration cycle apparatus 100 to that of a standard apparatus will be described. FIG. 6 is a graph illustrating the relationship between the hot-water-supply-side extension pipe length and the amount of refrigerant required in each operation mode when the indoor-side extension pipe length is 0 m. In FIG. 6, the vertical axis represents the required refrigerant amount (kg) and the horizontal axis represents the hot-water-supply-side extension pipe length (m).

In the cooling operation mode and the heating operation mode, refrigerant which is present at the hot-water-supply-side gas extension pipe 11 and the hot-water-supply-side liquid extension pipe 15 is in a gas-phase state. Therefore, the liquid refrigerant amount in the hot-water-supply-side gas extension pipe 11 and the hot-water-supply-side liquid extension pipe 15 can be ignored. Therefore, the required refrigerant amount in the cooling operation mode and the heating operation mode is constant with respect to the hot-water-supply-side extension pipe length. In the hot water supply operation mode and the cooling and hot water supply simultaneous operation mode, refrigerant which is present at the hot-water-supply-side liquid extension pipe 15 is in a liquid-phase state. Therefore, the required refrigerant amount in the hot water supply operation mode and the cooling and hot water supply simultaneous operation mode increases relative to the hot-water-supply-side extension pipe length.

As described in the earlier examination, in the case where the hot-water-supply-side extension pipe length is 0 m, the excess refrigerant amount for a cooling and hot water supply simultaneous system (the difference in required refrigerant amount between the cooling operation mode and the cooling and hot water supply simultaneous operation mode) is larger than the excess refrigerant amount for a standard apparatus (the difference in required refrigerant amount between the cooling operation mode and the heating operation mode).

Owing to the above relations, when the hot-water-supply-side extension pipe length is increased, the required refrigerant amount in the cooling operation mode is constant while the required refrigerant amount in the cooling and hot water supply simultaneous operation mode increases. Therefore, when the hot-water-supply-side extension pipe length becomes longer, the excess refrigerant amount decreases. Further, when the hot-water-supply-side extension pipe length is increased to La, the required refrigerant amount in the heating operation mode becomes that in the cooling and hot water supply simultaneous operation mode. In this case, the difference in required refrigerant amount between the cooling operation mode and the heating operation mode is equal to the difference in required refrigerant amount between the cooling operation mode and the cooling and hot water supply simultaneous operation mode. Therefore, the excess refrigerant amount for the standard apparatus is equal to the excess refrigerant for the refrigeration cycle apparatus 100, hence the equal amount is required for the capacity of the liquid reservoir. This means, by setting the shortest length of the hot-water-supply-side extension pipe length of the refrigeration cycle apparatus 100 to La, the liquid reservoir capacity may be set equal to that of the standard apparatus. In other words, a hot-water-supply-side extension pipe with a length less than La cannot be connected.

The shortest length La of the hot-water-supply-side extension pipe may be specifically obtained by the calculation described below. The state where the refrigerant required for a heating operation and the refrigerant required for a cooling and hot water supply simultaneous operation when the indoor-side extension pipe length is 0 m is obtained. When it is assumed that during a heating operation, the majority of refrigerant is present at the indoor-side heat exchanger 8 and the heat-source-side heat exchanger 4, and that during a cooling and hot water supply simultaneous operation, the majority of refrigerant is present at the water heat exchanger 12, the indoor-side heat exchanger 8, and the hot-water-supply-side liquid extension pipe 15, the following equation (1) is established.

$$V_{HEXI}\times\rho_{HEXI_COND}+V_{HEXO}\times\rho_{HEXO_EVA}=V_{HEXw}\times\rho_{HEXw_COND}+V_{HEXI}\times\rho_{HEXI_EVA}+V_{PLw_La}\times\rho_{I} \quad \text{Equation (1)}$$

where $V_{HEXI}$ represents the internal volume [m$^3$] of the indoor-side heat exchanger 8, $\rho_{HEXI_COND}$ represents the average refrigerant density [kg/m$^3$] when the indoor-side heat exchanger 8 is used as a condenser, $V_{HEXO}$ represents the internal volume [m$^3$] of the heat-source-side heat exchanger 4, $\rho_{HEXO_EVA}$ represents the average refrigerant density [kg/m$^3$] when the heat-source-side heat exchanger 4 is used as an evaporator, $V_{HEXw}$ represents the internal volume [m$^3$] of the water heat exchanger 12, $\rho_{HEXw_COND}$ represents the average refrigerant density [kg/m$^3$] when the water heat exchanger 12 is used as a condenser, $\rho_{HEXI_EVA}$ represents the average refrigerant density [kg/m$^3$] when the indoor-side heat exchanger 8 is used as an evaporator, $V_{PLw_La}$ represents the internal volume [m$^3$] when the hot-water-supply-side liquid extension pipe 15 has the shortest length, and $\rho_I$ represents the liquid refrigerant density [kg/m$^3$].

In the hot-water-supply-side liquid extension pipe 15, refrigerant is in a liquid-phase state, with the refrigerant density of the liquid refrigerant being about 1000 kg/m$^3$, hence $\rho_I$=1000 kg/m$^3$ is obtained. Here, $V_{HEXI}$, $V_{HEXO}$, and $V_{HEXw}$ may be determined by apparatus specifications and are accordingly known. However, $\rho_{HEXI_COND}$, $\rho_{HEXO_EVA}$, $\rho_{HEXw_COND}$, and $\rho_{HEXI_EVA}$ are unknowns and a simple method of obtaining them will be considered.

Figure 7:
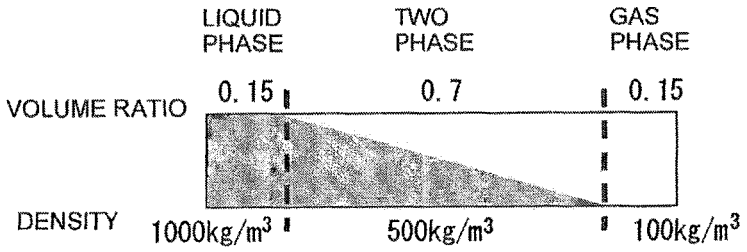
FIG. 7 is a schematic diagram illustrating the state of refrigerant when an air heat exchanger is a condenser.

FIG. 7 is a schematic diagram illustrating the state of refrigerant when an air heat exchanger serves as a condenser. As illustrated in FIG. 7, when the air heat exchanger serves as a condenser, refrigerant in the condenser is divided into a gas phase, a two-phase refrigerant, and a liquid phase, and the volume ratio of the gas phase to the two-phase refrigerant to the liquid phase is 0.15:0.7:0.15 in general and the refrigerant densities of these phases are about 1000 kg/m$^3$, 500 kg/m$^3$, and 100 kg/m$^3$, respectively. In the gas phase, both the refrigerant density and the volume ratio are small and therefore may be negligible. When $\rho_{HEXI_COND}$ is assumed to be simply expressed by $\rho_{HEXI_COND}=a_1\times\rho_I$, $a_1$ can be expressed as follows: $a_1=0.15+0.7\times500/1000=0.51\approx0.50$.

When the water heat exchanger serves as a condenser, a similar approach can be taken as with the case of the air heat exchanger. However, with the case of the water heat exchanger, the difference in water temperature between the inlet and the outlet is around 5 degrees Centigrade, making it impossible to make the degree of subcooling greater than the case of the air heat exchanger. Therefore, the temperature difference is no more than around 2 degrees Centigrade. Because of this, the volume ratio of the gas phase to the two-phase refrigerant to the liquid phase is 0.15:0.80:0.05. In terms of $\rho_{HEXw_COND}=a_2\times\rho_I$, $a_2$ can be expressed as follows: $a_2=0.05+0.80\times500/1000=0.45$. In the case where the air heat exchanger serves as an evaporator, refrigerant is divided into two phases: a gas phase and a two-phase refrigerant. The volume ratio of the gas phase to the two-phase refrigerant is 0.0:1.0 in general with a model of which a liquid reservoir is an accumulator, and 0.05 and 0.95 with a model of which a liquid reservoir is a receiver positioned at a high-pressure side, due to the degree of superheat at an evaporator outlet.

The refrigerant densities in the gas phase and the two-phase refrigerant are about 40 kg/m$^3$ and 200 kg/m$^3$, respectively. In the gas phase, both the refrigerant density and the volume ratio are small and therefore may be negligible. When $\rho_{HEXO_EVA}$ and $\rho_{HEXI_EVA}$ are assumed to be simply expressed by $\rho_{HEXI_EVA}=\rho_{HEXI_EVA}=a_3\times\rho_I$, $a_3$ can be expressed as follows: $a_3=1.0\times200/1000=0.20$.

In the above-mentioned way, each average refrigerant density may be converted into an expression using a liquid refrigerant density. By substituting an expression using the liquid refrigerant into each average refrigerant density of Equation (1), dividing both sides of the equation by $\rho_I$, and solving the equation for $V_{PLw_La}$, the following equation (2) can be obtained.

$$V_{PLw_La}=a_1\times V_{HEXI}-a_2\times V_{HEXw}+a_3\times(V_{HEXO}-V_{HEXI}) \quad \text{Equation (2)}$$

Here, $a_1$=0.50, $a_2$=0.45, and $a_3$=0.20. Specifically, when the approximate internal volume of each heat exchanger is, as shown above, 4.5 L ($V_{HEXO}$=0.0045) for the heat-source-side heat exchanger 4, 1.5 L ($V_{HEXI}$=0.0015) for the indoor-side heat exchanger 8, and 0.7 L ($V_{HEXw}$=0.0007) for the water heat exchanger 12, $V_{PLw_La}$ is 0.0010, which corresponds to 1.0 L.

Here, the volume ratio of the hot-water-supply-side liquid extension pipe 15 with respect to the water heat exchanger 12 is 1.43, which is the minimum volume ratio ($V_{PLw_La}/V_{HEXw}$=1.43). In other words, if it is desired to make a liquid reservoir volume equal to that of a standard apparatus by adding a hot water supply unit to the standard apparatus, the pipe length or the pipe diameter of the hot-water-supply-side extension pipe may be set so that the volume ratio of the hot-water-supply-side liquid extension pipe 15 with respect to the water heat exchanger 12 becomes 1.43 or more ($V_{PLw}/V_{HEXw}\geq1.43$). Here, $V_{PLw}$ represents the internal volume [m$^3$] of the hot-water-supply-side liquid extension pipe 15. First, a calculation method of the shortest length La with respect to an arbitrary pipe diameter will be shown below. The shortest length La of the hot-water-supply-side extension pipe and $V_{PLw_La}$ have a relation represented by the following equation (3).

$$V_{PLw_La}=\pi/4\times(\phi_{PLw}-2t_{PLw})^2\times La \quad \text{Equation (3)}$$

Here, $\pi$ represents the circular constant, $\phi_{PLw}$ represents the outer diameter [m] of the hot-water-supply-side liquid extension pipe 15, and $t_{PLw}$ represents the wall thickness [m] of the hot-water-supply-side liquid extension pipe 15. When the outer diameter of the hot-water-supply-side liquid extension pipe 15 is set to 9.52 mm and the wall thickness is set to 0.8 mm, due to $V_{PLw_La}$=0.0010, according to Equation (3), 20.3 m is obtained as the shortest length La of the hot-water-supply-side extension pipe. In other words, when the shortest length of the hot-water-supply-side extension pipe is set longer than 20.3 m, the volume ratio becomes equal to or more than 1.43, which is a minimum volume ratio.

Figure 8:
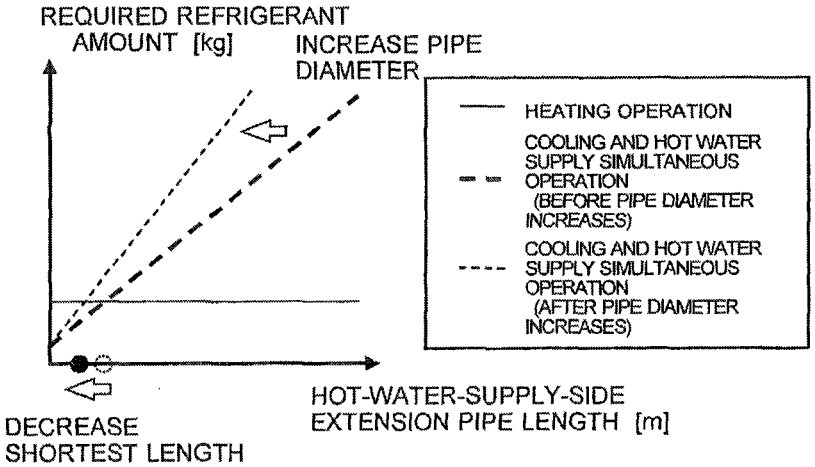
FIG. 8 is a graph illustrating the reducing effect of the shortest length of a hot-water-supply-side extension pipe when the pipe inner diameter of a hot-water-supply-side liquid extension pipe is increased.

As described above, the shortest length of the hot-water-supply-side extension pipe may be set as La. In the case where the pipe length of the hot-water-supply-side extension pipe is desired to be less than the shortest length La, a pipe to be used should have such an outer diameter or wall thickness that allows the pipe inner diameter to be large. FIG. 8 is a graph illustrating the reducing effect of the shortest length of the hot-water-supply-side extension pipe when the pipe inner diameter of the hot-water-supply-side liquid extension pipe 15 is increased. In FIG. 8, the vertical axis represents the required refrigerant amount (kg) and the horizontal axis represents the hot-water-supply-side extension pipe length (m).

FIG. 8 shows that by increasing the pipe inner diameter of the hot-water-supply-side liquid extension pipe 15, the internal volume becomes larger, allowing a larger amount of refrigerant to be stored. Specifically, when it is desired to set the hot-water-supply-side extension pipe length to, for example, 10.3 m (La=10.3 m), due to $V_{PLw_La}$=0.0010 $m^3$, according to Equation (3), a pipe inner diameter ($\phi_{PLw}-2t_{PLw}$)=0.0113 m is obtained and the outer diameter is 12.7 mm when the wall thickness is 0.8 mm. In other words, if a pipe with an inner diameter of 11.3 mm or larger is used, the pipe length can be set 10.3 m.

[Method of Additional Filling Refrigerant Amount Setting and Pipe Extension]

Figure 9:
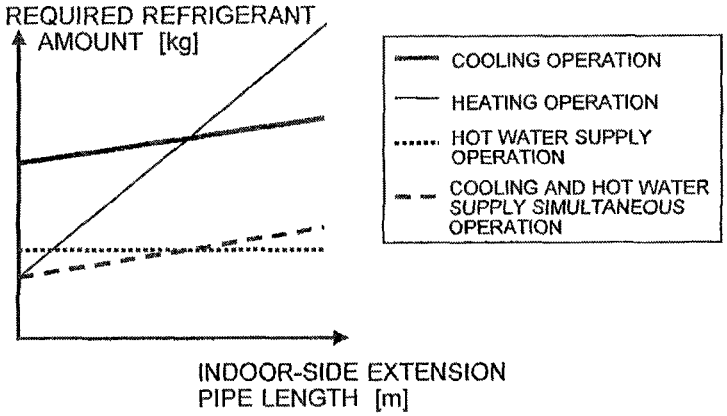
FIG. 9 is a graph illustrating changes in the amount of refrigerant required in each operation mode relative to the indoor-side extension pipe length when the hot-water-supply-side extension pipe length is La.

When the hot-water-supply-side extension pipe connecting the heat source unit 301 and the hot water supply unit 303 together and the indoor-side extension pipe connecting the heat source unit 301 and the indoor unit 302 together are long, it may be necessary in some cases to fill additional refrigerant to avoid shortage of refrigerant. A method of setting an additional filling refrigerant amount relative to the indoor-side extension pipe length and the hot-water-supply-side extension pipe length will be described below. FIG. 9 is a graph illustrating changes in the amount of refrigerant required in each operation mode relative to the indoor-side extension pipe length when the hot-water-supply-side extension pipe length is set to La. In FIG. 9, the vertical axis represents the required refrigerant amount (kg) and the horizontal axis represents the indoor-side extension pipe length (m).

In the cooling operation mode and the cooling and hot water supply simultaneous operation mode, refrigerant which is present at the indoor-side liquid extension pipe 7 is in a two-phase state. Therefore, the required refrigerant amount increases relative to the indoor-side extension pipe length. In the heating operation mode, refrigerant is in a liquid-phase state at the indoor-side liquid extension pipe 7. Therefore, the required refrigerant amount relative to the indoor-side extension pipe length increases more largely than the case with the heating operation mode and the cooling and hot water supply simultaneous operation mode. In the hot water supply operation mode, refrigerant which is present at the indoor-side gas extension pipe 9 and the indoor-side liquid extension pipe 7 is in a gas-phase state. Therefore, little refrigerant is required at the indoor-side gas extension pipe 9 and the indoor-side liquid extension pipe 7. Accordingly, the required refrigerant amount in the hot water supply operation mode is constant relative to the indoor-side extension pipe length.

In the case where the indoor-side extension pipe length is short, the required refrigerant amount is largest in the cooling operation mode. The required refrigerant amount increases relative to the indoor-side extension pipe length. In the case where the indoor-side extension pipe length is long, it is the heating operation mode that requires the largest required refrigerant amount. The required refrigerant amount increases relative to the indoor-side extension pipe length. The foregoing description demonstrates that the required refrigerant amount increases relative to the indoor-side extension pipe length, and the amount of required refrigerant is determined by the cooling operation mode when the indoor-side extension pipe length is short and by the heating operation mode when the indoor-side extension pipe length is long.

Next, changes in the required refrigerant amount with respect to the hot-water-supply-side extension pipe length in the case where the indoor-side extension pipe length is short will be discussed with reference to FIG. 6. When the hot-water-supply-side extension pipe length is short, the required refrigerant amount is largest in the cooling operation mode. In the cooling operation mode, the required refrigerant amount is constant relative to the hot-water-supply-side extension pipe length. Therefore, additional filling of refrigerant is unnecessary. When the hot-water-supply-side extension pipe length is long, the required refrigerant amount is largest in the hot water supply operation mode. In the hot water supply operation mode, the required refrigerant amount increases relative to the hot-water-supply-side extension pipe length. Therefore, additional filling of refrigerant is necessary.

Figure 10:
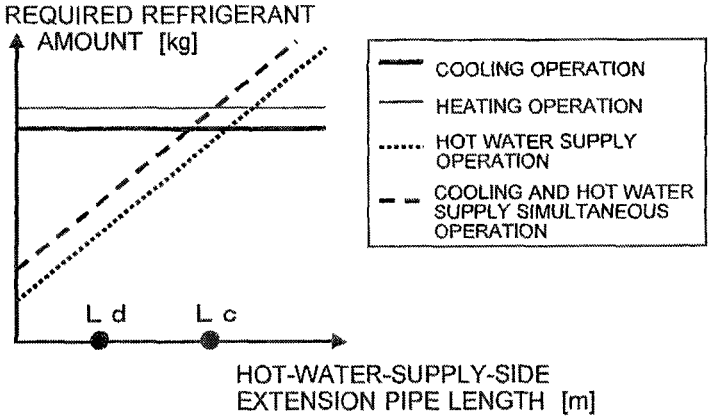
FIG. 10 is a graph illustrating the relationship of the amount of refrigerant required in each operation mode with respect to the hot-water-supply-side extension pipe length when the indoor-side extension pipe length is long.

Here, changes in the required refrigerant amount with respect to the hot-water-supply-side extension pipe length in the case where the indoor-side extension pipe length is long will further be discussed with reference to FIG. 10. FIG. 10 is a graph illustrating the relationship of the amount of refrigerant required in each operation mode to the hot-water-supply-side extension pipe length when the indoor-side extension pipe length is long. In FIG. 10, the vertical axis represents the required refrigerant amount (kg) and the horizontal axis represents the hot-water-supply-side extension length (m).

When the hot-water-supply-side extension pipe length is short, the required refrigerant amount is largest in the heating operation mode. In the heating operation mode, the required refrigerant amount is constant relative to the hot-water-supply-side extension pipe length. Therefore, additional filling of refrigerant is unnecessary. When the hot-water-supply-side extension pipe length is long, it is the cooling and hot water supply simultaneous operation mode that requires the largest required refrigerant amount. In the cooling and hot water supply simultaneous operation mode, the required refrigerant amount increases relative to the hot-water-supply-side extension pipe length. Therefore, additional filling of refrigerant is necessary. From the above, additional filling of refrigerant is unnecessary to the hot-water-supply-side extension pipe length when the hot-water-supply-side extension pipe length is short and additional filling of refrigerant is necessary to the hot-water-supply-side extension pipe length when the hot-water-supply-side extension pipe length is long. The amount of additional filling of refrigerant is determined by the hot water supply operation mode when the indoor-side extension pipe length is short and by the cooling and hot water supply simultaneous operation mode when the indoor-side extension pipe length is long.

For example, when the indoor-side extension pipe length is 0 m and the hot-water-supply-side extension pipe length is increased, as illustrated in FIG. 6, the required refrigerant amount in a cooling operation becomes larger than that in a hot water supply operation, requiring additional filling of refrigerant. To meet this requirement, in executing additional filling of refrigerant, since the required refrigerant amount in the heating operation mode does not change with respect to the hot-water-supply-side extension pipe length, it will bring a larger amount of excess refrigerant when a certain amount of refrigerant is used for additional filling. As a result, it will cause an overflow of refrigerant unless a liquid reservoir of a large capacity is provided. From the above, when a certain amount of refrigerant is used for additional filling in accordance with the hot-water-supply-side extension pipe length, it is likely that a large amount of excess refrigerant will undesirably occur.

One method of avoiding an increase in the excess refrigerant amount is to set the additional filling refrigerant amount based on the indoor-side extension pipe length independently of the hot-water-supply-side extension pipe length. This makes it possible to suppress an increase the an excess refrigerant amount. When this method is used, however, shortage of refrigerant does not occur in the case where the hot-water-supply-side extension pipe length is short, while in the case where the hot-water-supply-side extension pipe length is long, the amount of required refrigerant is large in an hot water supply operation, which causes a shortage of refrigerant unless additional filling of refrigerant is performed. A shortage of refrigerant degrades the operational performance of the refrigeration cycle apparatus 100, which is also not preferable.

When it is desired to make the hot-water-supply-side extension pipe length longer, the indoor-side extension pipe length may also be made longer and additional filling of refrigerant may be done. By increasing the indoor-side extension pipe length, additional filling of refrigerant is performed and thereby causing no shortage of refrigerant even if the hot-water-supply-side extension pipe length is increased. Hence, the upper limit length of the hot-water-supply-side extension pipe is set in accordance with the indoor-side extension pipe length, and the hot-water-supply-side extension pipe length is determined to be equal to or less than the upper limit length. The upper limit length of the hot-water-supply-side extension pipe refers to a length where no shortage of refrigerant occurs in the hot water supply operation mode or the cooling and hot water supply simultaneous operation mode.

The upper limit length of the hot-water-supply-side extension pipe is specifically obtained as described below for the case where the indoor-side extension pipe length is short and for the case where the indoor-side extension pipe length is long. In FIG. 9, the case where the indoor-side extension pipe length is short refers to the case where the required refrigerant amount in the cooling operation mode is larger than that in the heating operation mode, and the case where the indoor-side extension pipe length is long represents the case where the required refrigerant amount in the heating operation mode is larger than that in the cooling operation mode. The required refrigerant amounts relative to the indoor-side extension pipe length in the cooling operation mode and the heating operation mode can be obtained in advance by tests or the like. In the case where the indoor-side extension pipe length is short, the upper limit length is set to a length Lb where, in FIG. 6, the required refrigerant amount in the hot water supply operation mode is equal to the required refrigerant amount in the cooling operation mode.

Assuming that in the cooling operation mode, the majority of refrigerant is present at the heat-source-side heat exchanger 4, the indoor-side heat exchanger 8, and the indoor-side liquid extension pipe 7, and that in the hot water supply operation mode, the majority of refrigerant is present at the water heat exchanger 12, the heat-source-side heat exchanger 4, and the hot-water-supply-side liquid extension pipe 15, the following equation (4) is established for Lb.

$$V_{HEXO}\times\rho_{HEXO_COND}+V_{HEXI}\times\rho_{HEXI_EVA}+V_{PLc}\times\rho_{PLc_two}=V_{HEXw}\times\rho_{HEXw_COND}+V_{HEXO}\times\rho_{HEXO_EVA}+V_{PLw_Lb}\times\rho_{I} \quad \text{Equation (4)}$$

where $\rho_{HEXO_COND}$ represents the average refrigerant density [kg/m$^3$] when the heat-source-side heat exchanger 4 is used as a condenser, $\rho_{PLc_two}$ represents the average refrigerant density [kg/m$^3$] at the indoor-side liquid extension pipe 7 in the cooling operation mode and the cooling and hot water supply simultaneous operation mode, $V_{PLc}$ represents the internal volume [m$^3$] of the indoor-side liquid extension pipe 7, and $V_{PLw_Lb}$ represents the internal volume [m$^3$] of the hot-water-supply-side liquid extension pipe 15 when the length of a hot-water-supply-side extension pipe is the upper limit length Lb.

As for variables of the internal volume, $V_{PLw_Lb}$ is a value to be obtained, and when the indoor-side extension pipe length is determined, $V_{PLc}$ becomes known and $V_{HEXO}$, $V_{HEXI}$, and $V_{HEXw}$ are also known from apparatus specifications. As for the average refrigerant density, the liquid refrigerant density $\rho_I$ is known to be 1000 kg/m$^3$. However, others including $\rho_{HEXO_COND}$, $\rho_{HEXI_EVA}$, $\rho_{PLc_two}$, $\rho_{HEXw_COND}$, and $\rho_{HEXO_EVA}$ are unknown, and therefore a simple method of obtaining these values will be proposed as in the case described above. In the case where an air heat exchanger serves as a condenser, as described above, $\rho_{HEXI_COND}=\rho_{HEXO_COND}$ is assumed, and when $\rho_{HEXO_COND}=a_1\times\rho_1$ is expressed, $a_1$ can be expressed by $a_1=0.5$. When a water heat exchanger serves as a condenser, as described above, when $\rho_{HEXw_COND}=a_2\times\rho_I$ is expressed, $a_2$ can be expressed by $a_2=0.45$.

In the case where an air heat exchanger serves as an evaporator, as described above, when $\rho_{HEXI_EVA}=\rho_{HEXI_EVA}=a_3\times\rho_I$ is expressed, $a_3$ can be expressed by $a_3=0.2$. Here, $\rho_{PLc_two}$ represents the refrigerant density before refrigerant is heated at the indoor-side heat exchanger 8 in the cooling operation mode and the cooling and hot water supply simultaneous operation mode, and the refrigerant is in a two-phase state under a low-pressure atmosphere. Since the refrigerant density at this time is about 350 kg/m$^3$, when $\rho_{PLc_two}=a_4\times\rho_I$ is expressed, $a_4$ can be expressed by $a_4=350/1000=0.35$. From the above, by converting each average refrigerant density into an expression using the liquid refrigerant density, dividing both sides of the equation by $\rho_I$, and solving the equation for $V_{PLw_Lb}$, the following equation (5) can be obtained.

$$V_{PLw_Lb}=a_1\times V_{HEXO}-a_2\times V_{HEXw}a_3\times(V_{HEXI}-V_{HEXO})+a_4\times V_{PLc} \quad \text{Equation (5)}$$

where $a_1=0.50$, $a_2=0.45$, $a_3=0.20$, and as $=0.35$.

Specifically, the approximate internal volume of each heat exchanger is, as shown above, assumed to be 4.5 L ($V_{HEXO}=0.0045$) for the heat-source-side heat exchanger 4, 1.5 L ($V_{HEXI}=0.0015$) for the indoor-side heat exchanger 8, and 0.7 L ($V_{HEXw}=0.0007$) for the water heat exchanger 12. When the indoor-side extension pipe length is set to 15 m, with the outer diameter of the indoor-side liquid extension pipe 7 being 9.52 mm and the wall thickness being 0.8 mm, the internal volume is 0.7 L ($V_{PLc}$=0.0007 L). The internal volume of the hot-water-supply-side liquid extension pipe 15 in the case where the hot-water-supply-side extension pipe has the upper limit length Lb is 1.6 L ($V_{PLw_Lb}$=0.0016).

At this time, the volume ratio of the hot-water-supply-side liquid extension pipe 15 to the indoor-side liquid extension pipe 7 is 2.29, which is the upper limit volume ratio ($V_{PLw_Lb}/V_{PLc}$=2.29). In other words, the pipe length of the hot-water-supply-side extension pipe may be set so that the volume ratio of the hot-water-supply-side liquid extension pipe 15 to the indoor-side liquid extension pipe 7 becomes 2.29 or less ($V_{PLw}/V_{PLc}\leq 2.29$). Here, the upper limit length Lb can be obtained as described below. The upper limit length Lb of the hot-water-supply-side extension pipe and $V_{PLw_Lb}$ have a relation represented by the following equation (6).

Equation (6)

$$V_{PLw_Lb}=\pi/4\times(\phi_{PLw}-2t_{PLw})^2\times Lb \quad (6)$$

When the outer diameter of the hot-water-supply-side liquid extension pipe 15 is set to 9.52 mm and the wall thickness is set to 0.8 mm, because of $V_{PLw_Lb}$=0.0016, according to Equation (6), 32.5 m is obtained as the upper limit length Lb of the hot-water-supply-side extension pipe. In other words, if the pipe length is set to 32.5 m or less, the volume ratio is 2.29, which is the upper limit volume ratio, or below. In addition, if the pipe outer diameter is set to 12.7 mm and the wall thickness is set to 0.8 mm, 16.5 m is obtained as the upper limit length Lb of the hot-water-supply-side extension pipe. In other words, if the pipe length is set to 16.5 m or less, the volume ratio is 2.29, which is equal to or less than an upper limit volume ratio.

In the case where the indoor-side extension pipe length is long, the upper limit length is Lc where, in FIG. 10, the required refrigerant amount in the heating operation mode is equal to the required refrigerant amount in the cooling and hot water supply simultaneous operation mode. When it is assumed that in the heating operation mode, the majority of refrigerant is present at the indoor-side heat exchanger 8, the heat-source-side heat exchanger 4, and the indoor-side liquid extension pipe 7, and that in the cooling and hot water supply simultaneous operation mode, the majority of refrigerant is present at the indoor-side liquid extension pipe 7, the water heat exchanger 12, the indoor-side heat exchanger 8, and the hot-water-supply-side liquid extension pipe 15, the following equation (7) is established for Lc.

$$V_{HEXI}\times\rho_{HEXI_COND}+V_{HEXO}\times\rho_{HEXO_EVA}+V_{PLc}\times\rho_{PLc_I}=V_{PLc}\times\rho_{PLc_two}+V_{HEXw}\times\rho_{HEXw_COND}+V_{HEXI}\times\rho_{HEXI_EVA}+V_{PLw_Lc}\times\rho_I \quad \text{Equation (7)}$$

Here, $\rho_{PLc_I}$ represents the average refrigerant density [kg/m$^3$] of the indoor-side liquid extension pipe 7 in the heating operation mode, $V_{PLw_Lc}$ represents the internal volume [m$^3$] of the hot-water-supply-side liquid extension pipe 15 in the case where the hot-water-supply-side extension pipe has the upper limit length Lc. As for variables of the internal volume, $V_{PLw_Lc}$ is a value to be obtained, and when the indoor-side extension pipe length is determined, $V_{PLc}$ becomes known, and $V_{HEXO}$, $V_{HEXI}$, and $V_{HEXw}$ are also known from apparatus specifications.

The average refrigerant density is known with the liquid refrigerant density $\rho_I$ being 1000 kg/m$^3$, and as for $\rho_{PLc_I}$, refrigerant at the indoor-side liquid extension pipe 7 becomes liquid refrigerant in the heating operation mode. Therefore, $\rho_{PLc_I}=\rho_I$=1000 kg/m$^3$ can be known. Other variables: $\rho_{HEXI_COND}$, $\rho_{HEXO_EVA}$, $\rho$, $\rho_{HEXw_COND}$, $\rho_{HEXI_EVA}$, and $\rho_{PLc_two}$, are unknown. However, when a simple method of obtaining these values is used as described above, each average refrigerant density can be converted into an expression using the liquid refrigerant density $\rho_I$. From the above, by converting each average refrigerant density into an expression using the liquid refrigerant density, dividing both sides of the equation by $\rho_I$, and solving the equation for $V_{PLw_Lc}$, the following equation (8) can be obtained.

$$V_{PLw_Lc}=a_1\times V_{HEXI}-a_2\times V_{HEXw}+a_3\times(V_{HEXO}-V_{HEXI})+(1-a_4)\times V_{PLc} \quad \text{Equation (8)}$$

Here, $a_1$=0.50, $a_2$=0.45, $a_3$=0.20, and $a_4$=0.35.

Specifically, the approximate internal volume of each heat exchanger is, as shown above, set to 4.5 L ($V_{HEXO}$=0.0045) for the heat-source-side heat exchanger 4, 1.5 L ($V_{HEXI}$=0.0015) for the indoor-side heat exchanger 8, and 0.7 L ($V_{HEXw}$=0.0007) for the water heat exchanger 12. When the indoor-side extension pipe length is set to 40 m, with the outer diameter of the indoor-side liquid extension pipe 7 being set to 9.52 mm and the wall thickness being set to 0.8 mm, 2.0 L is obtained as the internal volume ($V_{PLc}$=0.002).

The internal volume of the hot-water-supply-side liquid extension pipe 15 at this time in the case where the hot-water-supply-side extension pipe hast the upper limit length Lc is 2.3 L ($V_{PLw_Lc}$=0.0023). Here, the volume ratio of the hot-water-supply-side liquid extension pipe 15 to the indoor-side liquid extension pipe 7 is 1.15, which is the upper limit volume ratio ($V_{PLw_Lc}/V_{PLc}$=1.15). In other words, the pipe length of the hot-water-supply-side extension pipe may be set so that the volume ratio of the hot-water-supply-side liquid extension pipe 15 to the indoor-side liquid extension pipe 7 becomes 1.15 or below ($V_{PLw}/V_{PLc}\leq 1.15$). The upper limit length Lc at this time can be obtained as described below. Between the upper limit length Lc of the hot-water-supply-side extension pipe and $V_{PLw_Lc}$, there is the relation represented by the following equation (9).

$$V_{PLw_LC}=\pi/4\times(\phi_{PLw}-2t_{PLw})^2\times Lc \quad \text{Equation (9)}$$

When the outer diameter of the hot-water-supply-side liquid extension pipe 15 is set to 9.52 mm and the wall thickness is set to 0.8 mm, because of $V_{PLw_Lc}$=0.0024, according to Equation (9), 46.7 m is obtained as the upper limit length Lc of a hot-water-supply-side extension pipe. In other words, if the pipe length is set to 46.7 m or less, the volume ratio is 1.15, which is the upper limit volume ratio, or below. In addition, if the pipe outer diameter is set to 12.7 mm and the wall thickness is set to 0.8 mm, the upper limit length Lc of the hot-water-supply-side extension pipe is 23.8 m. In other words, if the pipe length is set to 23.8 m or less, the volume ratio is 1.15, which is the upper limit volume ratio, or below. Thus, the upper limit length Lc of the hot-water-supply-side extension pipe can be obtained.

Here, as illustrated in FIG. 10, in the case where the indoor-side extension pipe length is long, decreasing the hot-water-supply-side extension pipe length from the upper limit length Lc will be considered. At this time, it is the heating operation mode that requires the largest required refrigerant amount and it is the hot water supply operation mode that requires the smallest required refrigerant amount. When the hot-water-supply-side extension pipe length is shortened, while the required refrigerant amount in the heating operation mode is constant, the required refrigerant amount in the hot water supply operation mode decreases. This increases the difference in required refrigerant amount between the heating operation mode and the hot water supply operation mode, and when the length becomes Ld or less, the excess refrigerant amount becomes larger than that of a standard apparatus. Therefore, when the hot-water-supply-side extension pipe length is desired to be decreased to Ld or less, it is necessary to shorten the indoor-side extension pipe length to reduce the filling refrigerant amount. This prevents the excess refrigerant amount from increasing even though the hot-water-supply-side extension pipe length is shortened.

To achieve this configuration, the lower limit length Ld of the hot-water-supply-side extension pipe is set in accordance with the indoor-side extension pipe length. The lower limit length Ld of the hot-water-supply-side extension pipe is such a length that the excess refrigerant amount becomes equal to the refrigerant amount in a liquid reservoir when the liquid reservoir is filled with liquid refrigerant, that is, the length where the difference in required refrigerant amount between the heating operation mode and the hot water supply operation mode is equal to the refrigerant amount in the liquid reservoir when the liquid reservoir is filled with liquid refrigerant. The case where the indoor-side extension pipe length is short will be discussed below. As illustrated in FIG. 6, within the range between the shortest length La and the upper limit length Lb of the hot-water-supply-side extension pipe length, the required refrigerant amount is constant in the cooling operation mode where the required refrigerant amount is largest and the required refrigerant amount is constant in the heating operation mode where the required refrigerant amount is smallest. Consequently, the excess refrigerant amount is constant, and hence the lower limit length is equal to the shortest length La.

The lower limit length Ld of the hot-water-supply-side extension pipe is obtained specifically as described below. When the hot-water-supply-side extension pipe has the lower limit length Ld, the difference in required refrigerant amount between the heating operation mode and the hot water supply operation mode is equal to the refrigerant amount when the liquid reservoir is filled with a liquid refrigerant. When in the heating operation mode, the majority of refrigerant is present at the indoor-side heat exchanger 8, the heat-source-side heat exchanger 4, and the indoor-side liquid extension pipe 7, and in the hot water supply operation mode, the majority of refrigerant is present at the water heat exchanger 12, the heat-source-side heat exchanger 4, and the hot-water-supply-side liquid extension pipe 15, the following equation (10) is established for Ld.

$$V_{ACC}\times\rho_I=(V_{HEXI}\times\rho_{HEXI_COND}+V_{HEXO}\times\rho_{HEXO_EVA}+V_{PLc}\times\rho_{PLc_I})-(V_{HEXw}\times\rho_{HEXw_COND}+V_{HEXO}\times\rho_{HEXO_EVA}+V_{PLw_Ld}\times\rho_I) \quad \text{Equation (10)}$$

Here, $V_{ACC}$ represents the effective internal volume [m$^3$] of a liquid reservoir, and in Embodiment 1, represents the effective internal volume of the accumulator 10. In the case of the accumulator 10, it is generally able to store a liquid refrigerant up to 80% of the internal volume. Therefore, the effective internal volume is 80% of the internal volume. $V_{PLw_Ld}$ is the internal volume [m$^3$] of the hot-water-supply-side liquid extension pipe 15 when the hot-water-supply-side extension pipe has the lower limit length Ld. As for variables of the internal volume, $V_{PLw_Ld}$ is a value to be obtained, and when the indoor-side extension pipe length is determined, $V_{PLc}$ becomes known and $V_{HEXO}$, $V_{HEXI}$, and $V_{HEXw}$ are also known from apparatus specifications.

The average refrigerant density is known with the liquid refrigerant density $\rho_I$ being 1000 kg/m$^3$, and as for $\rho_{PLc_I}$, refrigerant at the indoor-side liquid extension pipe 7 becomes a liquid refrigerant in the heating operation mode. Therefore, $\rho_{PLc_I}=\rho_I=1000$ kg/m$^3$, which can be known. As for other variables: $\rho_{HEXI_COND}$, $\rho_{HEXO_EVA}$, and $\rho_{HEXw_COND}$, which are unknown, when a simple method of obtaining these values is used as described above, each average refrigerant density can be converted into an expression using the liquid refrigerant density $\rho_I$. From the above, by converting each average refrigerant density into an expression using the liquid refrigerant density, dividing both sides of the equation by $\rho_I$, and solving the equation for $V_{PLw_Ld}$, the following equation (11) can be obtained.

$$V_{PLw_Ld}=V_{PLc}-V_{ACC}+a_1\times V_{HEXI}-a_2\times V_{HEXw} \quad \text{Equation (11)}$$

Here, $a_1=0.50$ and $a_2=0.45$.

Specifically, the internal volume of the accumulator 10 is set to 1.1 L, with the effective internal volume being set to 0.9 L ($V_{ACC}=0.0009$), and the approximate internal volume of each heat exchanger is, as shown above, set to 4.5 L ($V_{HEXO}=0.0045$) for the heat-source-side heat exchanger 4, 1.5 L ($V_{HEXI}=0.0015$) for the indoor-side heat exchanger 8, and 0.7 L ($V_{HEXw}=0.0007$) for the water heat exchanger 12. When the indoor-side extension pipe length is set to 40 m, with the outer diameter of the indoor-side liquid extension pipe 7 being set to 9.52 mm and the wall thickness being set to 0.8 mm, 2.0 L is obtained as the internal volume ($V_{PLc}$0.002).

The internal volume of the hot-water-supply-side liquid extension pipe 15 when the hot-water-supply-side extension pipe has the lower limit length Ld is, according to Equation (11), 1.5 L ($V_{PLw_Ld}=0.0015$). At this time, the volume ratio of the hot-water-supply-side liquid extension pipe 15 to the indoor-side liquid extension pipe 7 is 0.75, which is the lower limit volume ratio ($V_{PLw_Ld}/V_{PLc}=0.75$). In other words, the pipe length of the hot-water-supply-side extension pipe may be set so that the volume ratio of the hot-water-supply-side liquid extension pipe 15 to the indoor-side liquid extension pipe 7 becomes 0.75 or above ($V_{PLw}/V_{PLc}\geq 0.75$). The lower limit length Ld at this time can be obtained as described below. The lower limit length Ld of the hot-water-supply-side extension pipe and $V_{PLw_Ld}$ have a relation represented by the following equation (12).

$$V_{PLw_Ld}=\pi/4\times(\rho_{PLw}-2t_{PLw})^2\times Ld \quad \text{Equation (12)}$$

When the outer diameter of the hot-water-supply-side liquid extension pipe 15 is set to 9.52 mm and the wall thickness is set to 0.8 mm, because $V_{PLw_Ld}=0.0016$, according to Equation (12), 30.5 m is obtained as the lower limit length Ld of the hot-water-supply-side extension pipe. In other words, if the pipe length is set to 30.5 m or more, the volume ratio is 0.75, which is the lower limit volume ratio, or above. In addition, if the outer diameter is set to 12.7 mm and the wall thickness is set to 0.8 mm, 15.5 m is obtained as the lower limit length Ld of the hot-water-supply-side extension pipe. In other words, if the pipe length is set to 15.5 m or more, the volume ratio is 0.75, which is the lower limit volume ratio, or above.

Figure 11:
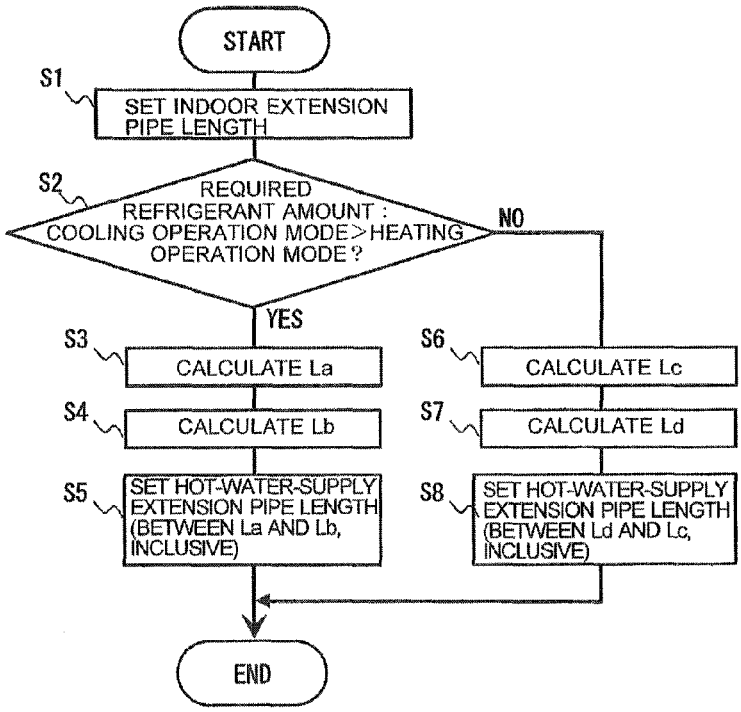
FIG. 11 is a flowchart illustrating a setting procedure of the indoor-side extension pipe length and the hot-water-supply-side extension pipe length of the refrigeration cycle apparatus according to Embodiment 1 of the present invention.

Based on the above, a setting procedure of the indoor-side extension pipe length and the hot-water-supply-side extension pipe length at the actual installation site will be described with reference to a flowchart in FIG. 11. FIG. 11 is a flowchart illustrating a setting procedure of the indoor-side extension pipe length and the hot-water-supply-side extension pipe length of the refrigeration cycle apparatus 100.

First, an operator sets the indoor-side extension pipe length (step S1). This is executed as the operator inputs the indoor-side extension pipe length to the controller 101.

Next, the controller 101 determines in which operation mode, the cooling operation mode or the heating operation mode, a larger amount of refrigerant is required (step S2). When it is determined that the required refrigerant amount in the cooling operation mode is larger than that in the heating operation mode (step S2; YES), the shortest length La of the hot-water-supply-side extension pipe length is calculated (step S3) and the upper limit length Lb of the hot-water-supply-side extension pipe length is calculated (step S4). Then, the controller 101 determines the hot-water-supply-side extension pipe length so that the hot-water-supply-side extension pipe length falls within the range between La and Lb, inclusive, and the process is terminated (step S5).

On the other hand, when it is determined that the required refrigerant amount in the heating operation mode is larger than that in the cooling operation mode (step S2; NO), the shortest length Lc of the hot-water-supply-side extension pipe length is calculated (step S6) and the upper limit length Ld of the hot-water-supply-side extension pipe length is calculated (step S7). Then, the controller 101 determines the hot-water-supply-side extension pipe length so that the hot-water-supply-side extension pipe length falls within the range between Lc and Ld, inclusive, and the process is terminated (step S8).

Figure 12:
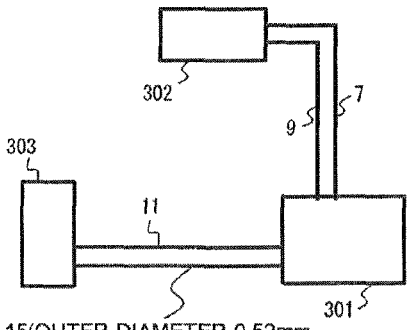
FIG. 12 includes image diagrams illustrating how to choose the pipe diameter relative to the pipe length of a hot-water-supply-side extension pipe.
Figure 12:
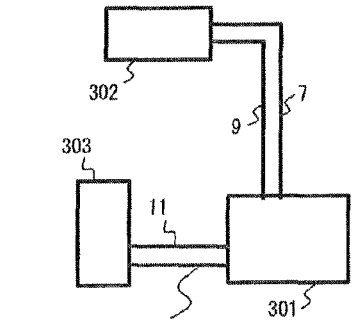

A specific operational image is as described below. FIG. 12 includes image diagrams illustrating how to select the pipe diameter relative to the pipe length of the hot-water-supply-side extension pipe. FIG. 12(*a*) illustrates an image in the case where the installation distance between the heat source unit 301 and the hot water supply unit 303 is long, and FIG. 12(*b*) illustrates an image in the case where the installation distance between the heat source unit 301 and the hot water supply unit 303 is short.

In the case where the hot water supply unit 303 is installed indoors and the distance between the heat source unit 301 and the hot water supply unit 303 is long (FIG. 12(*a*)), a hot-water-supply-side liquid extension pipe 15 with a diameter of 9.52 mm is used so as to extend the pipe to a certain distance. In contrast, In the case where the hot water supply unit 303 is installed outdoors and the distance between the heat source unit 301 and the hot water supply unit 303 is short (FIG. 12(*b*)), a hot-water-supply-side liquid extension pipe 15 with a diameter of 12.7 mm is used so as to shorten the pipe. Thus, by appropriately selecting a right pipe diameter according to the pipe length, it is possible to avoid sacrificing convenience in installment.

[Control Corresponding to Cooling and Hot Water Supply Simultaneous Operation Switching]

According to Embodiment 1, the accumulator 10 is used as a liquid reservoir. As described above, since the accumulator 10 has a function as a liquid reservoir, the accumulator stores an excess refrigerant. Since the accumulator 10 is positioned at the suction-side pipe 40 of the compressor 1, the accumulator 10, as another function, stores a liquid refrigerant generated temporarily at the time of a shift of the state of operation, thus preventing a large amount of liquid refrigerant from flowing into the compressor 1.

In particular, when the refrigeration cycle apparatus 100 detects a hot water supply instruction representing hot water supply ON in the cooling operation mode, the operation mode shifts from the cooling operation mode to the cooling and hot water supply simultaneous operation mode. At this time, the discharge solenoid valve 2*a* is changed from open to close, and the low-pressure equalization solenoid valve 18 is changed from close to open. Consequently, the gas side of the heat-source-side heat exchanger 4 is connected to the suction side of the compressor 1, and a large amount of refrigerant staying at the heat-source-side heat exchanger 4 goes through the low-pressure bypass pipe 17 and flows to the suction side of the compressor 1. When the accumulator 10 secures a certain internal volume, the accumulator 10 is not filled with liquid and is able to avoid liquid back at the compressor 1. However, if the accumulator 10 has only a small internal volume, the accumulator 10 is filled with liquid refrigerant and liquid back occurs at the compressor 1. This causes damage to the compressor 1.

As a method of avoiding liquid back at the compressor 1 at the time of a shift from the cooling operation mode to the cooling and hot water supply simultaneous operation mode, there is a method of reducing the refrigerant amount in the heat-source-side heat exchanger 4 in the cooling operation mode. The refrigerant amount in the heat-source-side heat exchanger 4 in the cooling operation mode decreases as the degree of subcooling on the liquid side of the heat-source-side heat exchanger 4 reduces. In other words, by opening the expansion valve 6 so that the degree of subcooling on the liquid side of the heat-source-side heat exchanger 4 is reduced to a predetermined value, the liquid refrigerant amount (liquid phase amount) at the heat-source-side heat exchanger 4 can be reduced, thus decreasing the refrigerant amount.

Here, the degree of subcooling on the liquid side of the heat-source-side heat exchanger 4 can be obtained by subtracting the temperature detected by the second temperature sensor 203 (heat-source-side heat exchanger liquid-side temperature detection means) from the saturation temperature of the pressure detected by the pressure sensor 201 (high-pressure detection means). The degree of subcooling on the liquid side of the heat-source-side heat exchanger 4 is adjusted by degree-of-subcooling cooling controlling means installed at the controller 101. For example, by changing the degree of subcooling of the heat-source-side heat exchanger 4 from 7 degrees Centigrade to 2 degrees Centigrade, it is possible to reduce the refrigerant amount by 12% at the heat-source-side heat exchanger 4 in the heat source unit 301 of 3HP. By employing this method, liquid back to the compressor 1 can be avoided at the time of switching from the cooling operation mode to the cooling and hot water supply simultaneous operation mode even if the internal volume of the accumulator 10 is not large.

Figure 13:
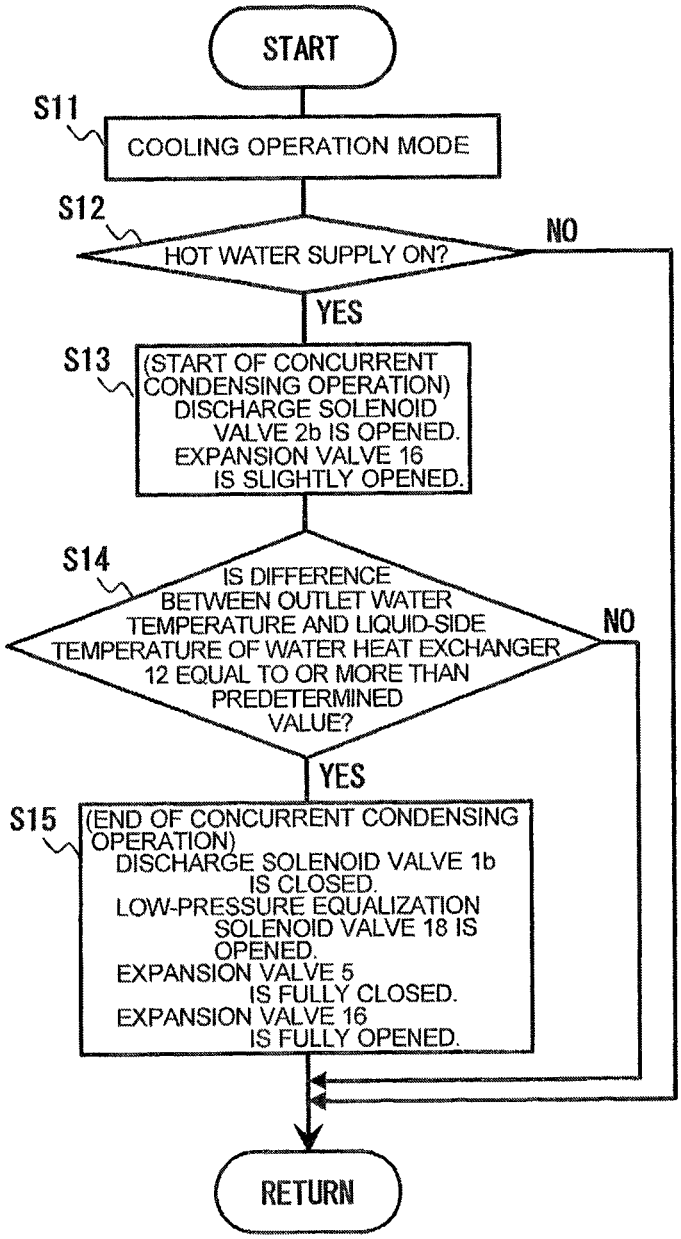
FIG. 13 is a flowchart illustrating the flow of a process at the time of a concurrent condensing operation.

However, in the case where liquid back to the compressor 1 occurs even when the above control is made at the time of switching from the cooling operation mode to the cooling and hot water supply simultaneous operation mode of the accumulator 10, the concurrent condensing operation described below may be performed. The concurrent condensing operation is executed by concurrent condensing operation execution means implemented in the controller 101. FIG. 13 is a flowchart illustrating the flow of a process during the concurrent condensing operation.

First, the controller 101 performs the cooling operation mode at the time of cooling ON (step S11). Next, the controller 101 determines whether hot water supply ON has been detected or not (step S12). In the case of hot water supply ON (step S12; YES), the controller 101 activates the water pump 13 to begin sending water.

When hot water supply ON is detected, the controller 101 starts a concurrent condensing operation (step S13). Specifically, by opening the discharge solenoid valve 2*b* and slightly opening the third expansion valve 16, and thereby letting refrigerant flow into the hot water supply unit 303, the controller 101 starts the concurrent condensing operation. Since the discharge solenoid valve 2*b* is opened, a high-temperature and high-pressure refrigerant discharged from the compressor 1 passes through the discharge solenoid valve 2*b* and the hot-water-supply-side gas extension pipe 11, and flows into the water heat exchanger 12. The refrigerant which has flowed into the water heat exchanger 12 emits heat into intermediate water, condenses, and progresses to the hot-water-supply-side liquid extension pipe 15. Accordingly, as the refrigerant flows into the hot water supply unit 303, the refrigerant accumulates in the water heat exchanger 12 and the hot-water-supply-side liquid extension pipe 15. In other words, the refrigerant staying in the heat-source-side heat exchanger 4 moves to the water heat exchanger 12 and the hot-water-supply-side liquid extension pipe 15.

As condensation of refrigerant proceeds at the water heat exchanger 12, subcooled liquid is generated on the liquid side of the water heat exchanger 12. In this state, refrigerant accumulated in the water heat exchanger 12 can be observed. This state is determined by the difference between the outlet water temperature and the liquid-side temperature of the water heat exchanger 12 (step S14). The outlet water temperature is the temperature detected by the sixth temperature sensor 207 (water heat exchanger outlet temperature detection means), and the liquid-side temperature of the water heat exchanger 12 is the temperature detected by the fourth temperature sensor 205 (water heat exchanger liquid-side temperature detection means).

Since the condensing temperature of the water heat exchanger 12 is almost equal to the outlet water temperature of the water heat exchanger 12, it is possible to determine, based on the outlet water temperature and the liquid-side temperature of the water heat exchanger 12, whether subcooled liquid is present at the liquid side of the water heat exchanger 12. In other words, when the liquid-side temperature of the water heat exchanger 12 is lower than the outlet water temperature by a predetermined value or more, for example, 2 degrees Centigrade or more (step S14; YES), the concurrent condensing operation is terminated (step S15). Specifically, by closing the discharge solenoid valve 2*b*, opening the low-pressure equalization solenoid valve 18, fully closing the first expansion valve 5, and fully opening the third expansion valve 16, the refrigerant open circuit state is changed to the open circuit state of the cooling and hot water supply simultaneous operation mode.

By the above operation, switching from the cooling operation mode to the cooling and hot water supply simultaneous operation mode can be made after the refrigerant present at the heat-source-side heat exchanger 4 has moved to the water heat exchanger 12 and the hot-water-supply-side liquid extension pipe 15, thereby avoiding liquid back to the compressor 1 without increasing the internal volume of the liquid reservoir of the accumulator 10.

In Embodiment 1, heating energy obtained by heat exchange at the water heat exchanger 12 in the hot water supply unit 303 is utilized for hot water supply at the hot water storage tank 14. However, the configuration is not limited to this. A configuration in which a hot water panel is installed, instead of the hot water storage tank 14, so as to be used as hot water floor heating.

As described above, the refrigeration cycle apparatus 100 according to Embodiment 1 is capable of independently performing a cooling operation, heating operation, and a hot water supply operation, and furthermore, an exhaust heat recovery operation through a cooling and hot water supply simultaneous operation. Additionally, with the refrigeration cycle apparatus 100, the volume ratio of the hot-water-supply-side liquid extension pipe 15 to the water heat exchanger 12 is set to be equal to or more than the minimum volume ratio when the required refrigerant amount during a cooling and hot water supply simultaneous operation is equal to the required refrigerant amount during a heating operation. Therefore, the internal volume of the liquid reservoir (accumulator 10) can be made equal to that of a standard apparatus, which performs only a cooling operation and a heating operation, thereby not only attaining a reduction in cost but also making the outer dimensions of the heat source unit 301 equal to those of the standard apparatus.

Embodiment 2

Figure 14:
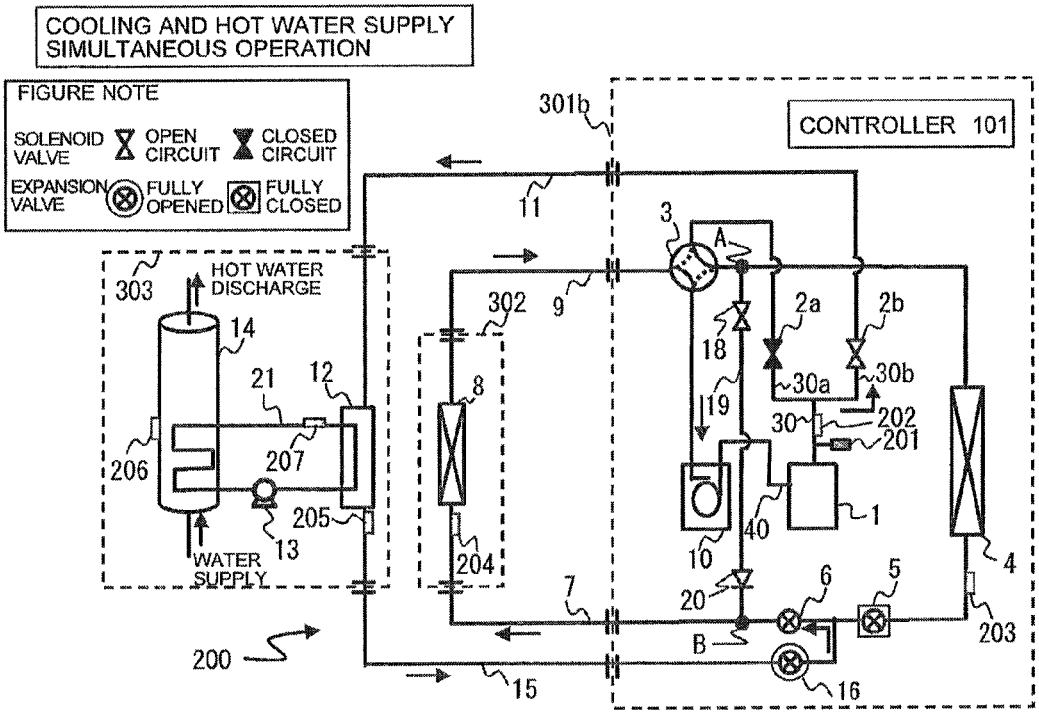
FIG. 14 is a schematic refrigerant circuit diagram illustrating a refrigerant circuit configuration of a refrigeration cycle apparatus according to Embodiment 2 of the present invention, and in particular, the flow of refrigerant at the time of a cooling and hot water supply simultaneous operation mode.

FIG. 14 is a schematic refrigerant circuit diagram illustrating a refrigerant circuit configuration of a refrigeration cycle apparatus 200 according to Embodiment 2 of the present invention, and in particular, the flow of refrigerant in the cooling and hot water supply simultaneous operation mode. Part of the configuration and operation of the refrigeration cycle apparatus 200 will be described with reference to FIG. 14. The arrows in FIG. 14 indicate the flow direction of refrigerant. In Embodiment 2, differences from Embodiment 1 described above will be mainly explained, and the same portions as those in Embodiment 1 will be referred to with the same signs and explanations thereof will be omitted.

As illustrated in FIG. 14, in the refrigeration cycle apparatus 200 according to Embodiment 2, a heat source unit 301*b* has a configuration different from the heat source unit 301 in the refrigeration cycle apparatus 100 according to Embodiment 1. Except for the heat source unit 301*b*, the configuration of the refrigeration cycle apparatus 200 according to Embodiment 2 is the same as that of the refrigeration cycle apparatus 100 according to Embodiment 1.

[Heat Source Unit 301*b*]

The heat source unit 301*b* includes a compressor 1, discharge solenoid valves 2*a* and 2*b*, a four-way valve 3, a heat-source-side heat exchanger 4, a first expansion valve 5, a second expansion valve 6, an accumulator 10, a third expansion valve 16, a low-pressure equalization solenoid valve 18, and a check valve 20.

The heat source unit 301*b* is provided with a low-pressure bypass pipe 19 for connecting a connection point A between the discharge solenoid valve 2*a* and the heat-source-side heat exchanger 4 via the four-way valve 3, and a connection point B between the second expansion valve 6 and an indoor-side heat exchanger 8 via the four-way valve 3. The low-pressure bypass pipe 19 is provided with the low-pressure equalization solenoid valve 18 and the check valve 20. The check valve 20 allows refrigerant to flow through the low-pressure bypass pipe 19 in one direction. Specifically, the low-pressure equalization solenoid valve 18 and the check valve 20 are positioned in this order from the connection point A to the connection point B in the low-pressure bypass pipe 19. The check valve 20 is positioned such that refrigerant flows from the connection point A toward the connection point B.

In the refrigeration cycle apparatus 200, a low-pressure two-phase refrigerant passes through the connection point B in the cooling and hot water supply simultaneous operation mode. In order to prevent a liquid refrigerant from entering the heat-source-side heat exchanger 4, the check valve 20 is installed. In other words, with the refrigeration cycle apparatus 200, the connecting position of a low-pressure bypass pipe and the presence or absence of a check valve are different from the refrigeration cycle apparatus 100 according to Embodiment 1.

[Effect Provided by Refrigeration Cycle Apparatus 200]

FIG. 14 illustrates the operational state of the refrigeration cycle apparatus 200 during the cooling and hot water supply simultaneous operation, which is similar to the operational state of the refrigeration cycle apparatus 100 according to Embodiment 1 during the cooling and hot water supply simultaneous operation. Likewise, the operational state of the refrigeration cycle apparatus 200 in the cooling operation mode, the heating operation mode, and the hot water supply operation mode is similar to that of the refrigeration cycle apparatus 100 according to Embodiment 1 in the corresponding operation modes. Accordingly, similar to the refrigeration cycle apparatus 100 according to Embodiment 1, the refrigeration cycle apparatus 200 is capable of avoiding liquid back to the compressor 1 at the time of a shift from the cooling operation mode to the cooling and hot water supply simultaneous operation mode even if the internal volume of the accumulator 10 is small.

Specifically, the following process is performed. When a hot water supply instruction representing hot water supply ON is detected in the cooling operation mode, the operation mode is changed from the cooling operation mode to the cooling and hot water supply simultaneous operation mode. At this time, the discharge solenoid valve 2*a* is changed from open to close and the low-pressure equalization solenoid valve 18 is changed from close to open. Because of this, the gas side of the heat-source-side heat exchanger 4 is connected to the connection point B of the low-pressure bypass pipe 19. A large amount of refrigerant staying in the heat-source-side heat exchanger 4 flows into the connection point B via the low-pressure bypass pipe 19, and after that, flows out of the heat source unit 301*b*, flows into the indoor unit 302 via the indoor-side liquid extension pipe 7, and then flows into the indoor-side heat exchanger 8. In the indoor-side heat exchanger 8, the refrigerant is heated by indoor air and gasified. The refrigerant which has flowed out of the indoor-side heat exchanger 8 flows out of the indoor unit 302, flows into the heat source unit 301*b* via the indoor-side gas extension pipe 9, passes through the accumulator 10, and is sucked in the compressor 1.

Thus, since the refrigerant which has flowed out of the heat-source-side heat exchanger 4 is heated by the indoor-side heat exchanger 8 and gasified, liquid back to the compressor 1 can be avoided. Owing to the above configuration, the liquid reservoir need not be positioned on the suction side of the compressor 1, and consequently, for example, the accumulator 10 may be removed and a receiver or the like may be installed, for example, between the expansion valve 5 and the expansion valve 6.

As described above, similar to the refrigeration cycle apparatus 100 according to Embodiment 1, the refrigeration cycle apparatus 200 according to Embodiment 2 is capable of independently performing a cooling operation, a heating operation, and a hot water supply operation, and furthermore, an exhaust heat recovery operation through a cooling and hot water supply simultaneous operation. Additionally, with the refrigeration cycle apparatus 200, the volume ratio of the hot-water-supply-side liquid extension pipe 15 to the water heat exchanger 12 is set to be equal to or more than the minimum internal volume ratio when the required refrigerant amount during a cooling and hot water supply simultaneous operation is equal to the required refrigerant amount during a heating operation. Therefore, the internal volume of the liquid reservoir (the accumulator 10 or the receiver) can be equal to that of a standard apparatus which performs only a cooling operation and a heating operation, thereby not only achieving a reduction in cost but also making the outer dimensions of the heat source unit 301*b* equal to those of the standard apparatus.

Embodiment 3

Figure 15:
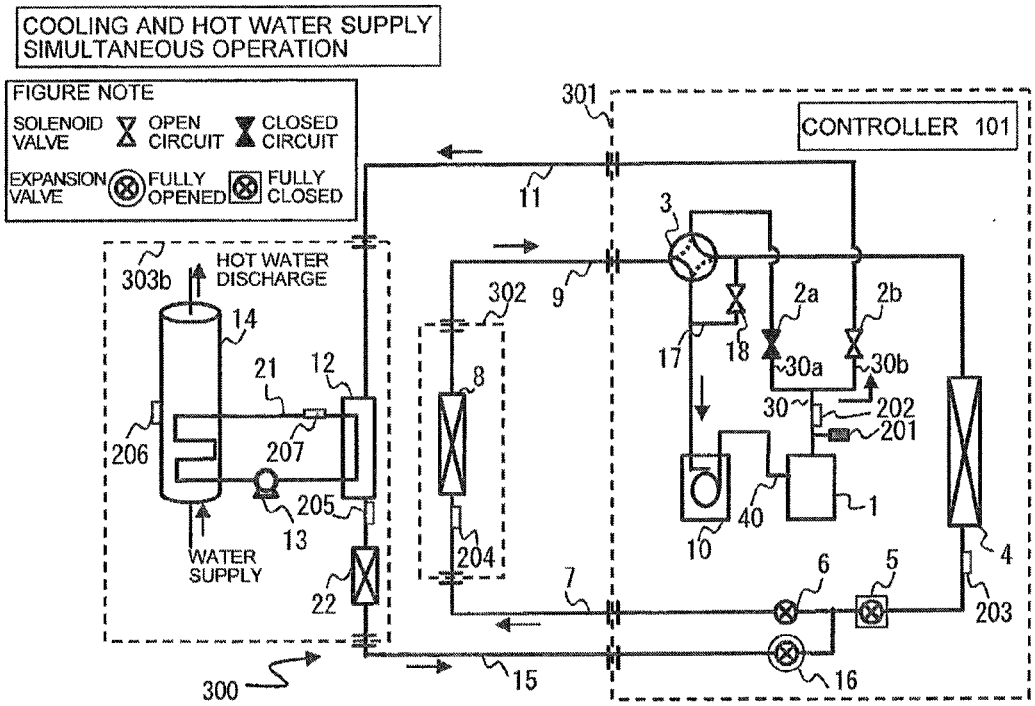
FIG. 15 is a schematic refrigerant circuit diagram illustrating a refrigerant circuit configuration of a refrigeration cycle apparatus according to Embodiment 3 of the present invention, and in particular, the flow of refrigerant at the time of the cooling and hot water supply simultaneous operation mode.

FIG. 15 is a schematic refrigerant circuit diagram illustrating a refrigerant circuit configuration of a refrigeration cycle apparatus 300 according to Embodiment 3 of the present invention, and in particular, the flow of refrigerant in the cooling and hot water supply simultaneous operation mode. A part of the configuration and operation of the refrigeration cycle apparatus 300 will be described with reference to FIG. 15. The arrows in FIG. 15 indicate the flow direction of refrigerant. In Embodiment 3, differences from Embodiment 1 and Embodiment 2 described above will be mainly explained, and the same portions as those in Embodiment 1 or Embodiment 2 will be referred to with the same signs and explanations thereof will be omitted.

As illustrated in FIG. 15, in the refrigeration cycle apparatus 300 according to Embodiment 3, a hot water supply unit 303*b* has a configuration different from the hot water supply unit 303 in the refrigeration cycle apparatus 100 according to Embodiment 1. Except for the hot water supply unit 303*b*, the configuration of the refrigeration cycle apparatus 300 according to Embodiment 2 is the same as that of the refrigeration cycle apparatus 100 according to Embodiment 1.

[Hot Water Supply Unit 303*b*]

Figure 16:
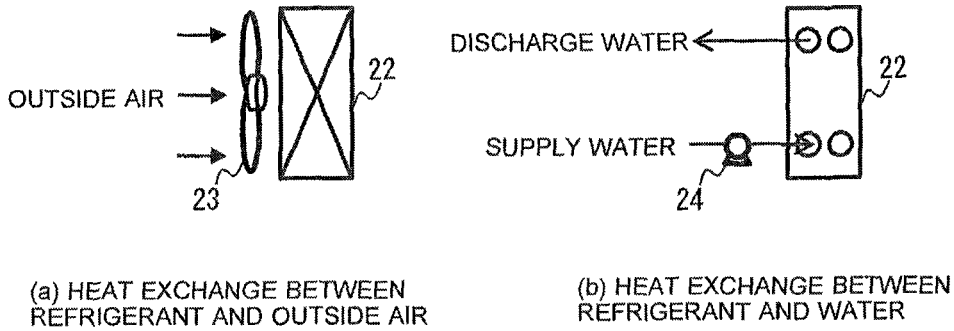
FIG. 16 includes schematic diagrams each illustrating a configuration of a subcooling heat exchanger.

The hot water supply unit 303*b* includes a water heat exchanger 12, a water-side circuit 21, a water pump 13, a hot water storage tank 14, and a subcooling heat exchanger 22. FIG. 16 schematically illustrates examples of the configuration of the subcooling heat exchanger 22. FIG. 16 includes schematic diagrams illustrating examples of the configuration of the subcooling heat exchanger 22.

The subcooling heat exchanger 22, as illustrated in FIG. 16(*a*), performs heat exchange between refrigerant and outside air, and may be configured, for example, by a cross-fin type fin-and-tube heat exchanger that includes a heat transfer pipe and a large number of fins. In this case, an air-sending fan 23 is installed and heat exchange with outside air is performed. Therefore, the hot water supply unit 303 is installed outdoors. Alternatively, the subcooling heat exchanger 22, as illustrated in FIG. 16(*b*), performs heat exchange between refrigerant and water, and is desirably configured by, for example, a plate-type water heat exchanger. In this case, a water pump 24 is desirably installed on a water supply side for discharging heated water. The air-sending fan 23 or the water pump 24 may be capable of variably controlling the rotation speed or may be maintained at a constant speed.

[Cooling and Hot Water Supply Simultaneous Operation Mode]

The operational state of the cooling and hot water supply simultaneous operation mode of the refrigeration cycle apparatus 300 will be described with reference to FIG. 15. The arrows in FIG. 15 indicate the flow direction of refrigerant. In the case of the cooling and hot water supply simultaneous operation mode illustrated in FIG. 15, the heat source unit 301 switches the four-way valve 3 such that the suction side of the compressor 1 is connected to the gas side of the indoor-side heat exchanger 8 (solid lines illustrated in FIG. 15). Further, the discharge solenoid valve 2*a* is controlled to close the circuit (solid), the discharge solenoid valve 2*b* is controlled to open the circuit (void), and the low-pressure equalization solenoid valve 18 is controlled to open the circuit (void). Moreover, the first expansion valve 5 is controlled to have the minimum opening degree (fully closed), the second expansion valve 6 is controlled to have a desired opening degree, and the third expansion valve 16 is controlled to have the maximum opening degree (fully opened).

A low-temperature and low-pressure refrigerant is compressed by the compressor 1 and discharged as a high-temperature and high-pressure gas refrigerant. The high-temperature and high-pressure gas refrigerant discharged from the compressor 1 passes through the discharge solenoid valve 2*b*, and flows out of the heat source unit 301. After that, the refrigerant flows into the hot water supply unit 303*b* via the hot-water-supply-side gas extension pipe 11. The refrigerant which has flowed into the hot water supply unit 303*b* flows into the water heat exchanger 12, heats water supplied by the water pump 13, and turns into a high-pressure liquid refrigerant. Then, the liquid refrigerant flows out of the water heat exchanger 12. After that, the refrigerant flows into the subcooling heat exchanger 22, is further cooled, and turns to a high-pressure liquid refrigerant with a high degree of subcooling. The refrigerant, after flowing out of the hot water supply unit 303*b*, flows into the heat source unit 301 via the hot-water-supply-side liquid extension pipe 15.

After that, the refrigerant passes through the third expansion valve 16, and is decompressed by the second expansion valve 6 to turn into a low-pressure two-phase refrigerant. The two-phase refrigerant then flows out of the heat source unit 301. The refrigerant which has flowed out of the heat source unit 301 flows into the indoor unit 302 via the indoor-side liquid extension pipe 7. The refrigerant which has flowed into the indoor unit 302 flows into the indoor-side heat exchanger 8, cools indoor air, and turns into a low-temperature and low-pressure gas refrigerant. The refrigerant which has flowed out of the indoor-side heat exchanger 8 then flows out of the indoor unit 302, flows into the heat source unit 301 via the indoor-side gas extension pipe 9, and is sucked in the compressor 1 through the four-way valve 3 and the accumulator 10.

In the refrigeration cycle apparatus 300, with the subcooling heat exchanger 22, a high-pressure liquid refrigerant with a higher degree of subcooling, that is, a liquid refrigerant of a temperature lower than that for the refrigeration cycle apparatus in Embodiment 1 or Embodiment 2, flows into the hot-water-supply-side liquid extension pipe 15. Since the density of liquid refrigerant increases as the temperature decreases, the average refrigerant density at the hot-water-supply-side liquid extension pipe 15 rises, and therefore, with the same internal volume, a large amount of refrigerant can be stored compared to the refrigeration cycle apparatus according to Embodiment 1 or Embodiment 2.

For example, it is assumed that when hot water is discharged at 55 degrees Centigrade using a R410A refrigerant, with a condensing temperature of 55 degrees Centigrade, the degree of subcooling of the water heat exchanger 12 is 2 degrees Centigrade. In the case where the subcooling heat exchanger 22 is not provided, the average refrigerant density at the hot-water-supply-side liquid extension pipe 15 is 888 kg/m$^3$. In contrast, in the case where the subcooling heat exchanger 22 is provided, the degree of subcooling at the subcooling heat exchanger 22 is, for example, 13 degrees Centigrade, and the average refrigerant density at the hot-water-supply-side liquid extension pipe 15 is 978 kg/m$^3$. In the case where the hot-water-supply-side liquid extension pipe 15 has the same internal volume, the amount of refrigerant corresponding to the increase in the average refrigerant density can be stored. In the case where the subcooling heat exchanger 22 is provided, the amount of stored refrigerant increases by about 10%.

With the effect described above, in the refrigeration cycle apparatus 300, the shortest length of the hot-water-supply-side extension pipe can be shortened compared to the refrigeration cycle apparatuses according to Embodiments 1 and 2. Further, in the refrigeration cycle apparatus 300, in adjusting the shortest length of the hot-water-supply-side extension pipe to a desired length, a hot-water-supply-side extension pipe having a small pipe inner diameter can be used. Instead of the heat source unit 301 of the refrigeration cycle apparatus 300, the heat source unit 301*b* of the refrigeration cycle apparatus 200 according to Embodiment 2 may be installed.

As described above, similar to the refrigeration cycle apparatus 100 according to Embodiment 1, the refrigeration cycle apparatus 300 according to Embodiment 3 is capable of independently performing a cooling operation, a heating operation, and a hot water supply operation, and furthermore, an exhaust heat recovery operation through a cooling and hot water supply simultaneous operation. Additionally, with the refrigeration cycle apparatus 300, the volume ratio of the hot-water-supply-side liquid extension pipe 15 to the water heat exchanger 12 is set to be equal to or more than the minimum volume ratio when the required refrigerant amount during a cooling and hot water supply simultaneous operation is equal to the required refrigerant amount during a heating operation. Therefore, the internal volume of the liquid reservoir (accumulator 10) may be made equal to that of a standard apparatus, which performs only a cooling operation and a heating operation, thereby not only attaining a reduction in cost but also making the outer dimensions of the heat source unit 301 equal to those of the standard apparatus.

REFERENCE SIGNS LIST

1: compressor, 2*a*: discharge solenoid valve, 2*b*: discharge solenoid valve, 3: four-way valve, 4: heat-source-side heat exchanger, 5: first expansion valve, 6: second expansion valve, 7: indoor-side liquid extension pipe, 8: indoor-side heat exchanger, 9: indoor-side gas extension pipe, 10: accumulator, 11: hot-water-supply-side gas extension pipe, 12: water heat exchanger, 13: water pump, 14: hot water storage tank, 15: hot-water-supply-side liquid extension pipe, 16: third expansion valve, 17: low-pressure bypass pipe, 18: low-pressure equalization solenoid valve, 19: low-pressure bypass pipe, 20: check valve, 21: water-side circuit, 22: subcooling heat exchanger, 23: air-sending fan, 24: water pump, 30: discharge-side pipe, 30*a*: discharge-side pipe, 30*b*: discharge-side pipe, 40: suction-side pipe, 100: refrigeration cycle apparatus, 101: controller, 200: refrigeration cycle apparatus, 201: pressure sensor, 202: first temperature sensor, 203: second temperature sensor, 204: third temperature sensor, 205: fourth temperature sensor, 206: fifth temperature sensor, 207: sixth temperature sensor, 300: refrigeration cycle apparatus, 301: heat source unit, 301*b*: heat source unit, 302: heat source unit, 303: hot water supply unit, 303*b*: hot water supply unit

The invention claimed is:

1. A refrigeration cycle apparatus comprising:

a heat source unit including a compressor, a heat-source-side heat exchanger, an expansion valve, and a liquid reservoir;

an indoor unit including an indoor-side heat exchanger; and a hot water supply unit including a water heat exchanger, the heat source unit and the indoor unit being connected together by indoor-side liquid extension pipes including an indoor-side liquid extension pipe and an indoor-side gas extension pipe, and the heat source unit and the hot water supply unit being connected together by hot-water-supply-side liquid extension pipes including a hot-water-supply-side liquid extension pipe and a hot-water-supply-side gas extension pipe, wherein the refrigeration cycle apparatus performs a cooling and hot water supply simultaneous operation in which the indoor-side heat exchanger serves as an evaporator and the water heat exchanger serves as a condenser, a heating operation in which the heat-source-side heat exchanger serves as an evaporator and the indoor-side heat exchanger serves as a condenser, and a cooling operation in which the heat-source-side heat exchanger serves as a condenser and the indoor-side heat exchanger serves as an evaporator, a capacity of the heat-source-side heat exchanger is larger than a capacity of the indoor-side heat exchanger and the water heat exchanger, and the hot-water-supply side liquid extension pipe and the water heat exchanger have a volume ratio of the hot-water-supply-side liquid extension pipe to the water heat exchanger is equal to or more than a volume ratio of the hot-water-supply-side liquid extension pipe to the water heat exchanger when a required refrigerant amount during the cooling and hot water supply simultaneous operation is equal to a required refrigerant amount during the heating operation.

2. The refrigeration cycle apparatus of claim 1, wherein the volume ratio of the hot-water-supply-side liquid extension pipe to the water heat exchanger is set based on at least one of a length of the hot-water-supply-side extension pipes and an inner diameter of the hot-water-supply-side liquid extension pipe.

3. The refrigeration cycle apparatus of claim 1, wherein an additional filling refrigerant amount to the refrigeration cycle apparatus is set based not on the length of the hot-water-supply-side extension pipes but on the length of the indoor-side extension pipes.

4. The refrigeration cycle apparatus of claim 1, wherein the volume ratio of the hot-water-supply-side liquid extension pipe to the indoor-side liquid extension pipe is, in a case where a required refrigerant amount during a cooling operation in which the indoor-side heat exchanger serves as an evaporator, the heat-source-side heat exchanger serves as a condenser, and cooling energy is supplied from the indoor-side heat exchanger is greater than the required refrigerant amount during the heating operation, set to be equal to or less than an upper limit volume ratio, which is the volume ratio of the hot-water-supply-side liquid extension pipe to the indoor-side liquid extension pipe when a required refrigerant amount during a hot water supply operation in which the heat-source-side heat exchanger serves as an evaporator, the water heat exchanger serves as a condenser, and heating energy is supplied from the water heat exchanger is equal to the required refrigerant amount during the cooling operation, and in a case where the required refrigerant amount during the heating operation is greater than the required refrigerant amount during the cooling operation, set to be equal to or less than an upper limit volume ratio, which is the volume ratio of the hot-water-supply-side liquid extension pipe to the indoor-side liquid extension pipe when the required refrigerant amount during the cooling and hot water supply simultaneous operation is equal to the required refrigerant amount during the heating operation.

5. The refrigeration cycle apparatus of claim 4, wherein in a case where the required refrigerant amount during the heating operation is greater than the required refrigerant amount during the cooling operation, the volume ratio of the hot-water-supply-side liquid extension pipe to the indoor-side liquid extension pipe is set to be equal to or more than a lower limit volume ratio, which is the volume ratio of the hot-water-supply-side liquid extension pipe to the indoor-side liquid extension pipe when a difference in required refrigerant amount between the heating operation and the hot water supply operation is equal to the amount of refrigerant in the liquid reservoir in a state in which an effective internal volume of the liquid reservoir is filled with liquid refrigerant.

6. The refrigeration cycle apparatus of claim 4, wherein the heat source unit includes:

a high-pressure sensor that detects a high pressure of refrigerant at a position that falls within a range from the compressor to the expansion valve;

a heat-source-side heat exchanger liquid-side temperature sensor that detects a temperature of refrigerant on a liquid side of the heat-source-side heat exchanger; and a controller including a degree-of-subcooling controlling unit that controls an opening degree of the expansion valve so that the degree of subcooling of the refrigerant on the liquid side of the heat-source-side heat exchanger during the cooling operation has a predetermined value or below.

7. The refrigeration cycle apparatus of claim 6, wherein the predetermined value is a predetermined value that prevents a liquid refrigerant from flowing from the liquid reservoir to the compressor of the heat-source-side unit.

8. The refrigeration cycle apparatus of claim 4, wherein a concurrent condensing operation in which the indoor-side heat exchanger serves as an evaporator, the water heat exchanger serves as a condenser, and the heat-source-side heat exchanger serves as a condenser is possible, and wherein a concurrent condensing operation execution unit that executes the concurrent condensing operation before switching is performed from the cooling operation to the cooling and hot water supply simultaneous operation is provided.

9. The refrigeration cycle apparatus of claim 8, wherein the hot water supply unit includes:

a water heat exchanger outlet water temperature sensor that detects an outlet water temperature at the water heat exchanger; and a water heat exchanger liquid-side temperature sensor that detects a temperature of refrigerant on a liquid side of the water heat exchanger, and wherein the concurrent condensing operation execution unit terminates the concurrent condensing operation when the temperature of the refrigerant on the liquid side of the water heat exchanger becomes lower than the outlet water temperature by a predetermined value or more in the concurrent condensing operation.

10. The refrigeration cycle apparatus of claim 1, wherein the heat source unit includes a low-pressure bypass pipe for connecting a connection point A at a position that falls within a range between the compressor and a gas side of the heat-source-side heat exchanger, and a connection point B at a position that falls within a range between the indoor-side heat exchanger and the expansion valve, and wherein a low-pressure equalization solenoid valve and a check valve are installed at the low-pressure bypass pipe so that refrigerant flows from the connection point A toward the connection point B.

11. The refrigeration cycle apparatus of claim 1, wherein the hot water supply unit includes a subcooling heat exchanger for cooling refrigerant serving as subcooled liquid on a liquid side of the water heat exchanger.

12. The refrigeration cycle apparatus of claim 1, further comprising a controller configured to determine that a current operation mode of the heat source unit, the indoor unit, and the hot water supply unit is a cooling operation, determine that the current operation mode is being switched from the cooling operation to the cooling and hot water supply simultaneous operation, and operate a concurrent condensing operation to prevent refrigerant from flowing from the liquid reservoir to the compressor during a transition between the cooling operation to the cooling and hot water supply simultaneous operation in response to an affirmative determination that the current operation mode is being switched to the cooling and hot water supply simultaneous operation.

13. The refrigeration cycle apparatus of claim 12, wherein the concurrent condensing operation decreases a degree of subcooling of the heat-source-side heat exchanger to a predetermined value that prevents a liquid refrigerant from flowing from the liquid reservoir to the compressor of the heat-source-side unit.

* * * * *